US006154193A

United States Patent [19]

Wakimoto

[11] Patent Number: 6,154,193

[45] Date of Patent: Nov. 28, 2000

[54] DISPLAY CONTROLLER

[75] Inventor: Kingo Wakimoto, Itami, Japan

[73] Assignee: Mitsubishi Denki Kabushiki Kaisha, Tokyo, Japan

[21] Appl. No.: 08/226,472

[22] Filed: Apr. 11, 1994

[30] Foreign Application Priority Data

Apr. 12, 1993 [JP] Japan ..... 5-084526

[51] Int. Cl.[7] ..... G09G 5/26

[52] U.S. Cl. ..... 345/130; 345/132

[58] Field of Search ..... 345/127, 130, 345/132, 136; 348/441, 445, 458

[56] References Cited

U.S. PATENT DOCUMENTS

| | | | |
|---|---|---|---|
| 4,292,653 | 9/1981 | Bock et al. | 348/458 |
| 4,471,381 | 9/1984 | Kasuga et al. | 348/458 |
| 4,496,974 | 1/1985 | Hietmann | 348/458 |
| 4,768,092 | 8/1988 | Ishikawa | 348/458 |
| 4,866,520 | 9/1989 | Nomura et al. | 345/136 X |

FOREIGN PATENT DOCUMENTS

| | | |
|---|---|---|
| 0287333 A2 | 10/1988 | European Pat. Off. . |
| 3044915 C2 | 9/1981 | Germany . |
| 3309847 A1 | 9/1983 | Germany . |
| 3840839 A1 | 12/1988 | Germany . |

*Primary Examiner*—Kent Chang

*Attorney, Agent, or Firm*—Oblon, Spivak, McCelland, Maier & Neustadt, P.C.

[57] ABSTRACT

In order to obtain a vertically enlarged image with no indentation, reset timing of a data skipping counter is changed between odd and even lines by one horizontal scanning line by an output of a selector. Thus, data skipping timing for a signal by an AND gate is displaced between odd and even frames by one horizontal scanning line, whereby positions of inserted lines overlappingly read from a display memory in correspondence to the skipping are also displaced between odd and even frames by one horizontal scanning line. Further, color data of the inserted lines are converted to those having low chromaticity levels by +1 processing by an adder, to be supplied to a display unit. Thus, indentation of an oblique thin line, for example, is blurred so that a smooth vertically enlarged image is obtained.

6 Claims, 24 Drawing Sheets

B
COUNT VALUE OF DATA SKIPPING COUNTER 19
0
1
2
3
0
1
CARRY SIGNAL C OF DATA SKIPPING COUNTER 19
OUTPUT OF AND GATE 20
HEAD ADDRESS OF EACH LINE (OUTPUT OF CIRCUIT 10)
1ST LINE
2ND LINE
3RD LINE
4TH&5TH LINES
6TH LINE
VS
LH
FS
CARRY SIGNAL OF 2-BIT COUNTER 33

FS
OUTPUT OF T FLIP-FLOP 31
B
LH
OUTPUT OF SELECTOR 32
COUNT VALUE OF DATA SKIPPING COUNTER 19
0
1
2
0
1
2
3
0

FIG. 5

| FRAME | 1 | 2 | 3 | 4 | 5 | 6 | 7 | 8 |
|---|---|---|---|---|---|---|---|---|
| 1 | 1 | 1 | 1 | 1 | 1 | 1 | 1 | 1 |
| 2 | 2 | 2 | 2 | 2 | 2 | 2 | 2 | 2 |
| LINE ↓ 3 | 3 | 3 | 3 | 3 | 3 | 3 | 3 | 3 |
| 4 | 4 | 4 | 4 | 4 | 4 | 4 | 4 | 4 |
| 5 | 4 | 5 | 4 | 5 | 4 | 5 | 4 | 5 |
| 6 | 5 | 5 | 5 | 5 | 5 | 5 | 5 | 5 |

FS
B
COUNT VALUE OF 2-BIT COUNTER 40
OUTPUT OF AND GATE 41
Q0
Q1
Q2
Q3
SHIFT REGISTER 42
Q0
Q1
Q2
COUNTER 44
OUTPUT OF SELECTOR 46
OUTPUT OF AND GATE 20

FIG. 11

| FRAME | 1 | 2 | 3 | 4 | 5 | 6 | 7 | 8 |
|---|---|---|---|---|---|---|---|---|
| 1 | 1 | 1 | 1 | 1 | 1 | 1 | 1 | 1 |
| 2 | 1 | 2 | 2 | 2 | 2 | 2 | 2 | 2 |
| LINE ↓ 3 | 2 | 2 | 2 | 3 | 3 | 3 | 3 | 3 |
| 4 | 3 | 3 | 3 | 3 | 3 | 4 | 4 | 4 |
| 5 | 4 | 4 | 4 | 4 | 4 | 4 | 4 | 5 |
| 6 | 5 | 5 | 5 | 5 | 5 | 5 | 5 | 5 |

1ST FRAME

2ND FRAME

3RD FRAME

4TH FRAME

5TH FRAME

6TH FRAME

7TH FRAME

8TH FRAME

PRIOR ART FIG. 13
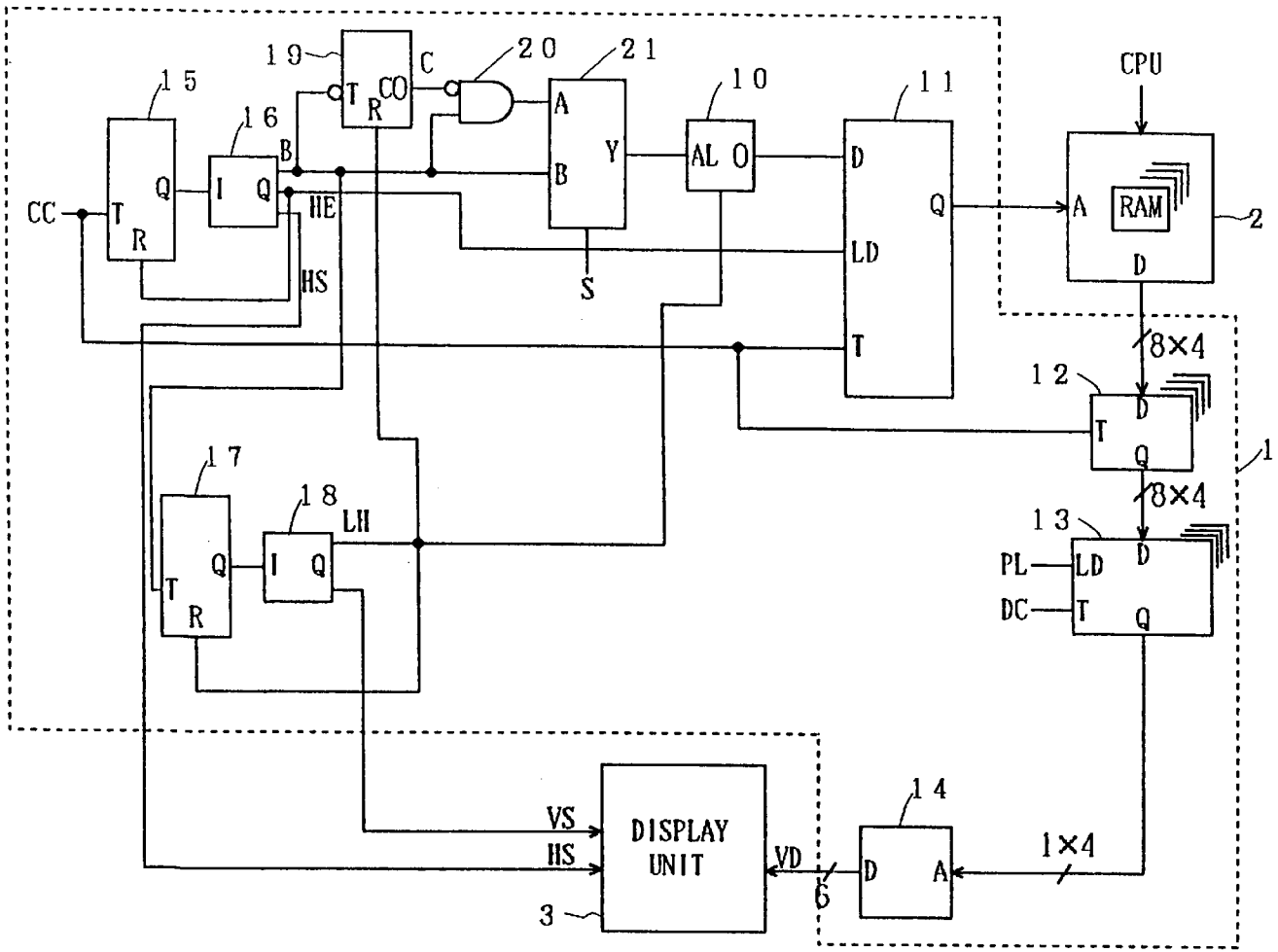

CC
0
1
2
3
4
78
79
80
81
82
83
0
B
HE
HS

B
COUNT VALUE OF DATA SKIPPING COUNTER 19
CARRY SIGNAL C OF DATA SKIPPING COUNTER 19
OUTPUT OF AND GATE 20
HEAD ADDRESS OF EACH LINE (OUTPUT OF CIRCUIT 10)
VS
LI
0
1
2
3
1ST LINE
2ND LINE
3RD LINE
4TH&5TH LINE
6TH LINE
FINAL LINE

PRIOR ART FIG. 18
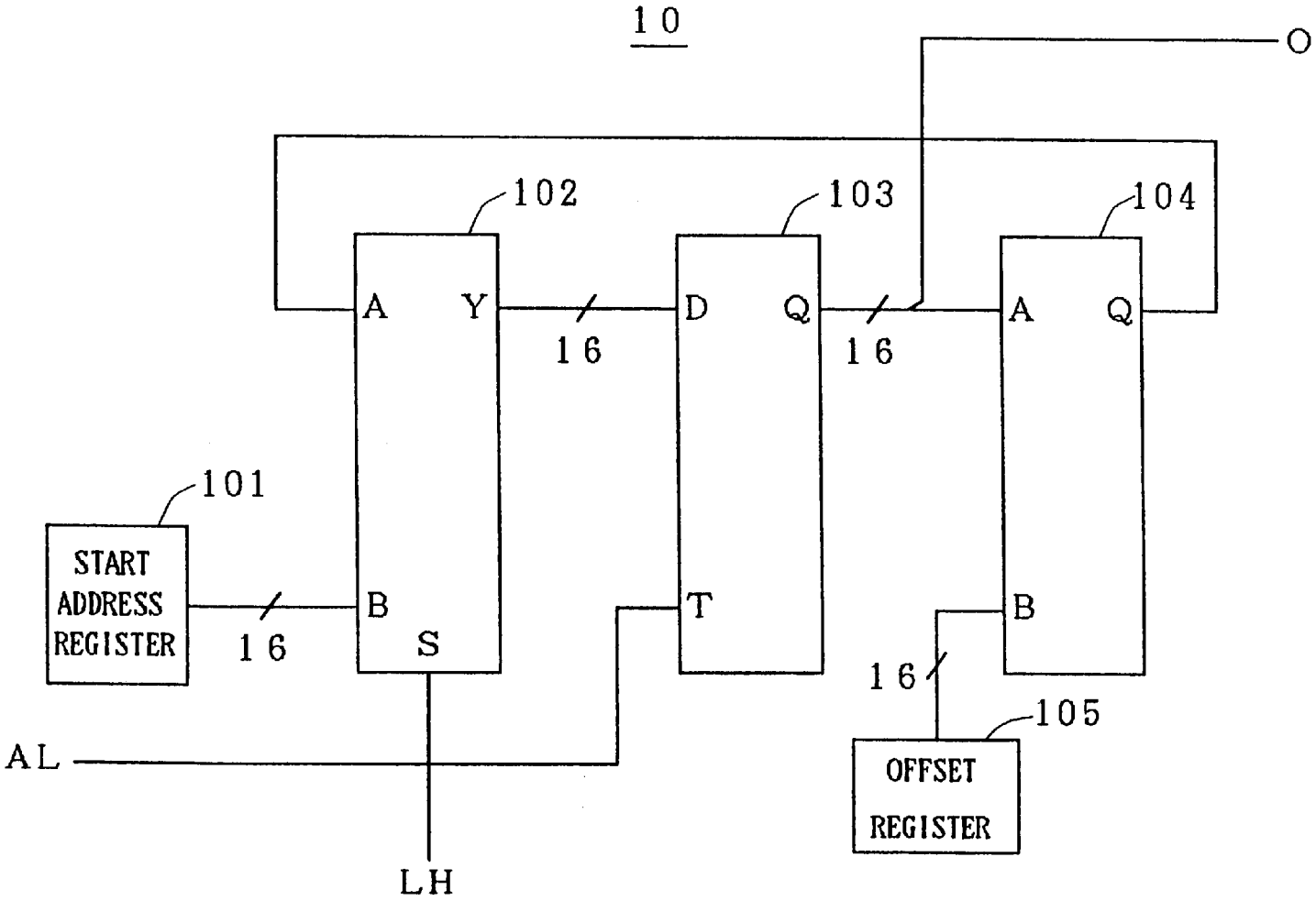

PRIOR ART FIG. 19
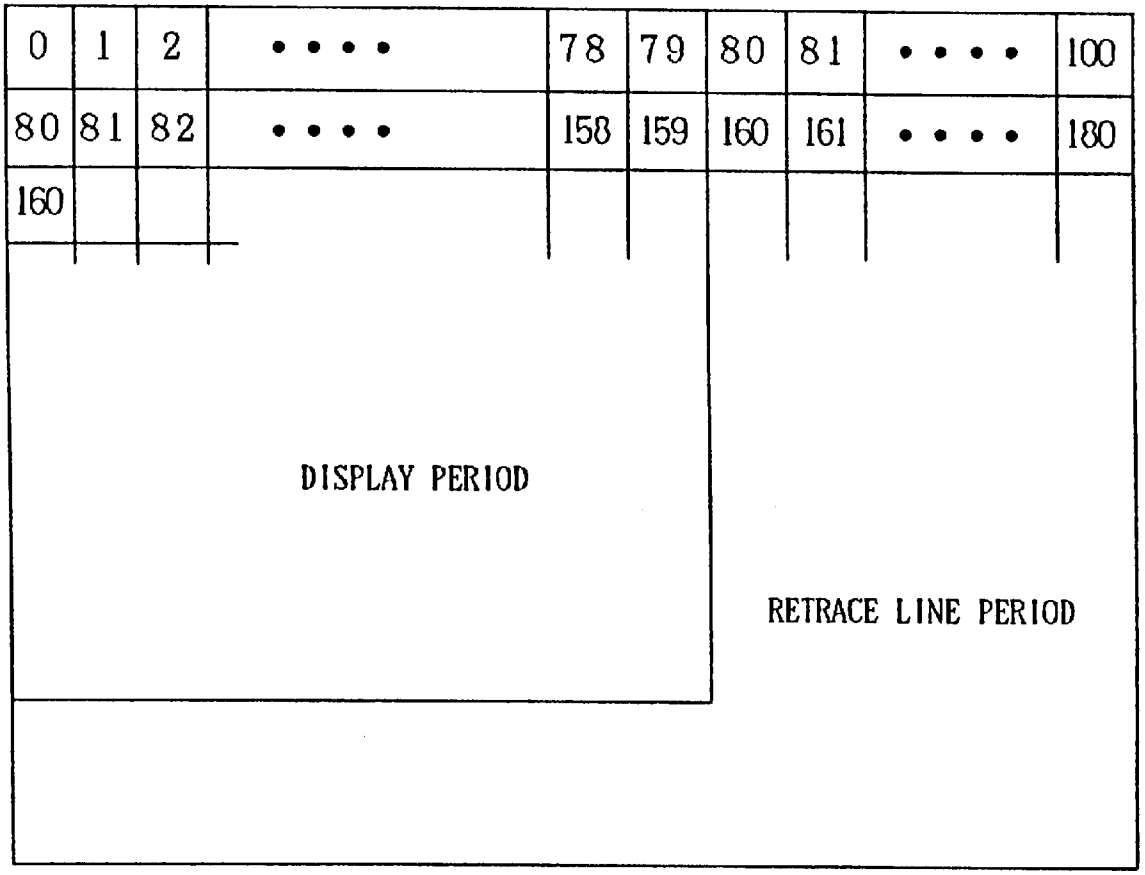

CC
A INPUT OF DISPLAY MEMORY 2
B OUTPUT OF DISPLAY MEMORY 2
OUTPUT OF DISPLAY DATA LATCH 12
PL
DC
OUTPUT OF SHIFT REGISTER 13
0000h
0001h
0002h
0003h
AAh
BBh
CCh
DDh
AAh
BBh
CCh
1010101010

FIG. 21
PRIOR ART

| FRAME | 1 | 2 | 3 | 4 | 5 | 6 | 7 | 8 |
|---|---|---|---|---|---|---|---|---|
| 1 | ① | ① | ① | ① | ① | ① | ① | ① |
| 2 | ② | ② | ② | ② | ② | ② | ② | ② |
| LINE ↓ 3 | ③ | ③ | ③ | ③ | ③ | ③ | ③ | ③ |
| 4 | ④ | ④ | ④ | ④ | ④ | ④ | ④ | ④ |
| 5 | ④ | ④ | ④ | ④ | ④ | ④ | ④ | ④ |
| 6 | ⑤ | ⑤ | ⑤ | ⑤ | ⑤ | ⑤ | ⑤ | ⑤ |

DISPLAY CONTROLLER

BACKGROUND OF THE INVENTION

1. Field of the Invention

The present invention relates to a display controller for executing control for making a display unit display images in response to data which are stored in a display memory, and more particularly, it relates to a display controller for displaying images on a display unit such as an LCD (liquid crystal display) in a vertically enlarged manner.

2. Background of the Invention

For example, standards of 400 and 480 horizontal scanning lines are known as software standards in relation to screen display of a personal computer. In order to attain compatibility between these standards, it is necessary to vertically enlarge or reduce images.

FIG. 13 is a block diagram showing a conventional display controller 1 for displaying images in a vertically enlarged manner. This display controller 1 executes control for making a display unit 3 such as an LCD display images in response to data which are stored in a display memory 2. The data stored in the display memory 2 are supplied from a CPU. The storage data are read from the display memory 2 in accordance with addresses which are supplied from the display controller 1. The as-read data are processed in the display controller 1 as hereinafter described in detail, and supplied to the display unit 3 as color image data VD. The display unit 3 is also supplied with horizontal and vertical synchronizing signals HS and VS from the display controller 1. Thus, images which are responsive to the data stored in the display memory 2 are displayed on the display unit 3.

The display controller 1 comprises a horizontal counter 15, a horizontal timing generation circuit 16, a vertical counter 17 and a vertical timing generation circuit 18, as parts for generating various timing signals. The horizontal counter 15 receives a clock CC in its timing input T, while receiving a signal HE from the horizontal timing generation circuit 16 in its reset input R. The horizontal timing generation circuit 16 receives a count output from the horizontal counter 15 in its input I, and outputs the horizontal synchronizing signal HS, a signal B and the signal HE from its output Q. These signals HS, B and HE are shown in a timing chart of FIG. 14. The signal B indicates a retrace line period, and the signal HE shows the last timing of the retrace line period. Referring to FIG. 14, numerals provided on the respective pulses of the clock CC denote count values of the horizontal counter 15.

FIG. 15 is a block diagram showing the horizontal timing generation circuit 16 in detail. The horizontal timing generation circuit 16 comprises registers 161*a*, 161*b*, 161*c* and 161*d* which can be set from the exterior. A horizontal total character value A, a horizontal display end timing value B, a horizontal synchronizing signal start timing value C and a horizontal synchronizing signal end timing value D are set in the registers 161*a*, 161*b*, 161*c* and 161*d* respectively. The values A, B, C and D set in the respective registers 161*a*, 161*b*, 161*c* and 161*d* are compared with the count value of the horizontal counter 15 by comparators 162*a*, 162*b*, 162*c* and 162*d* respectively. Comparison outputs of the comparators 162*a*, 162*b*, 162*c* and 162*d* are supplied to data inputs D of D flip-flops 163, 165, 166 and 167 respectively. Timing inputs T of the D flip-flops 163, 165 and 166 are supplied with the clock CC, while a timing input T of the D flip-flop 167 is supplied with the signal HE, which is outputted from the D flip-flop 163. On the other hand, a D flip-flop 164 is supplied with the output of the D flip-flop 163 and the clock CC in its data and timing inputs D and T respectively.

Outputs of the D flip-flops 164 and 165 are supplied to set and reset inputs S and R of an RS flip-flop 168 respectively. Further, outputs of the D flip-flops 166 and 167 are supplied to set and reset inputs S and R of another RS flip-flop 169 respectively. The aforementioned values A, B, C and D are properly set so that the horizontal synchronizing signal HS and the signals B and HE are derived from the RS flip-flops 169 and 168 and the D flip-flop 163 respectively.

Referring again to FIG. 13, the vertical counter 17 receives the signal B and a signal LH from the horizontal and vertical timing generation circuits 16 and 18 in its timing and reset inputs T and R respectively. A count output of the vertical counter 17 is supplied to an input I of the vertical timing generation circuit 18, which in turn outputs the vertical synchronizing signal VS and the signal LH shown in a timing chart of FIG. 16 from its output Q. The signal LH shows the final line of one frame.

FIG. 17 is a block diagram showing the vertical timing generation circuit 18 in detail. The vertical timing generation circuit 18 comprises registers 181*a*, 181*b* and 181*c* which can be set from the exterior. A vertical total line value E, a vertical synchronizing signal start timing value F and a vertical synchronizing signal end timing value G are set in the registers 181*a*, 181*b* and 181*c* respectively. The respective values set in the registers 181*a*, 181*b* and 181*c* are compared with the count output of the vertical counter 17 by comparators 182*a*, 182*b* and 182*c* respectively. Comparison outputs of the comparators 182*a*, 182*b* and 182*c* are supplied to data inputs D of D flip-flops 183, 184 and 185 respectively. The D flip-flops 183, 184 and 185 are also supplied in timing inputs T thereof with the signal B from the horizontal timing generation circuit 16.

Outputs of the D flip-flops 184 and 185 are supplied to set and reset inputs S and R of an RS flip-flop 186 respectively. Thus, the respective values E, F and G are properly set in the registers 181*a*, 181*b* and 181*c* so that the signals VS and LH shown in the timing chart of FIG. 16 are derived from the RS flip-flop 186 and the D flip-flop 183 respectively.

Referring again to FIG. 13, the display controller 1 also comprises a head address generation circuit 10 and an address counter 11 as parts for generating addresses of the display memory 2. The display controller 1 further comprises a data skipping counter 19, an AND gate 20, and a selector 21 as parts for data-skipping a reference signal for address generation. The data skipping counter 19 is formed by a 2-bit counter in this example.

The data skipping counter 19 is supplied with the signals B and LH from the horizontal and vertical timing generation circuits 16 and 18 in its negative logic timing and reset inputs T and R respectively. The data skipping counter 19 outputs a carry signal C every time its count value reaches 3, so that the carry signal C is supplied to a negative logic input of the AND gate 20. The AND gate 20 is supplied in its another input with the signal B from the horizontal timing generation circuit 16, while its output is supplied to an A input of the selector 21. The selector 21 is supplied in its B input with the signal B from the horizontal timing generation circuit 16. The selector 21 selects the signal received in the A or B input in response to a selection signal S, to output the same.

The head address generation circuit 10 receives the signal from the selector 21 and the signal LH from the vertical timing generation circuit 18, to generate a head address of each horizontal scanning line in accordance with these signals by a predetermined rule. The address counter 11 receives the head address from the head address generation circuit 10 in its data input D. The address counter 11 further receives the signal HE from the horizontal timing generation circuit 16 and the clock CC in its load and timing inputs LD and T respectively. The address counter 11 loads the head address in response to the signal HE, and up-counts the addresses one by one from the head address in response to the clock CC. These addresses are supplied to an address input A of the display memory 2.

FIG. 18 is a block diagram showing the head address generation circuit 10 in detail. The head address generation circuit 101 comprises a start address register 101, a selector 102, a D flip-flop 103, a full adder 104, and an offset register 105. The selector 102 receives an output of the full adder 104 in its A input, while receiving a start address which is previously stored in the start address register 101 in its B input. The signal LH from the vertical timing generation circuit 18 indicating the final line of one frame is supplied to a selection input S of the selector 102, which in turn selects its B input in response to a high level of the signal LH while selecting its A input in response to a low level of the signal LH. Namely, the selector 102 outputs the start address which is stored in the start address register 101 only at the last of one frame, while outputting the output of the full adder 104 in other case. The D flip-flop 103 receives the output of the selector 102 in its data input D, to latch this signal in response to a signal which is supplied to its timing input T, i.e., a signal which is supplied to an input AL of the head address generation circuit 10 from the selector 21. The D flip-flop 103 is formed by 16 D flip-flops which are provided in parallel with each other in correspondence to a 16-bit output from the selector 102.

Each data latched in the D flip-flop 103 is outputted from an output O as the head address of each horizontal scanning line. Namely, different head addresses are successively outputted every time a signal is received in the input AL of the head address generation circuit 10 from the selector 21, i.e., every horizontal scanning line. The full adder 104 receives the output of the D flip-flop 103 in its A input, while receiving an offset value which is previously set in the offset register 105 in its B input. The full adder 104 outputs a value, which is obtained by adding the offset value stored in the offset register 105 to the currently outputted head address, as a head address for a next horizontal scanning line. This head address is latched by and outputted from the D flip-flop 103 in response to a next Al input.

FIG. 19 illustrates states of counts of the address counter 11 in display and retrace line periods. The address counter 11, which continues counting also in the retrace line period, must discontinuously count the addresses at the beginning of a next display period, i.e., at the beginning of the next horizontal scanning line. A head address for generating such discontinuous addresses is generated every horizontal scanning line in the head address generation circuit 10 as hereinabove described, to be supplied to the address counter 11.

Referring to FIG. 19, zero is stored in the start address register 101 as a start address, while 80 is stored in the offset register 105 as an offset value. Thus, head addresses of first, second, third . . . horizontal scanning lines are changed as 0, 80, 160, . . .

Referring again to FIG. 13, the selector 21 selects and outputs the signal B which is supplied to its B input in response to the selection signal S in a mode of not vertically enlarging the screen. The signal B indicating a retrace line period is generated every horizontal scanning line, whereby the head address is changed every horizontal scanning line.

In a mode of vertically enlarging the screen, on the other hand, the selector 21 selects and outputs the signal from the AND gate 20, which is supplied to its A input, in response to the selection signal S. The output signal from the AND gate 20 is obtained by data-skipping the signal B at a prescribed rate, as shown in the timing chart of FIG. 16. Namely, the data skipping counter 19, which is a 2-bit counter, outputs the carry signal C every time its count value reaches 3, as shown in FIG. 16. The AND gate 20 is closed in response to the carry signal C, so that the signal B is data-skipped at this timing. Therefore, the head address which is generated by the head address generation circuit 10 remains unchanged. Namely, the head address in a preceding horizontal scanning line is employed as such also in a next horizontal scanning line.

Referring to FIG. 16, the head address generation circuit 10 outputs the same head address for fourth and fifth horizontal scanning lines. Therefore, the display memory 2 is supplied with the same address over two horizontal scanning lines, and the same data are read from the display memory 2 over the two horizontal scanning lines. Therefore, an original single line (the fourth horizontal scanning line in FIG. 16) is enlarged to two lines, to be displayed. Since the data skipping counter 19 is a 2-bit counter, such operation is caused at a rate of one line every four horizontal scanning lines. Therefore, the overall screen is vertically enlarged to ⅔ times the initial screen for display.

Since the data skipping counter 19 is reset by the signal LH indicating the final line of one frame, the same horizontal scanning line is thereafter continuously enlarged to two lines so far as the selection signal S is in an enlargement mode. FIG. 21 shows this state, in which the fourth horizontal scanning line of the original image is repeated in the fourth and fifth horizontal scanning lines in every frame.

The display controller 1 shown in FIG. 13 further comprises a display data latch 12, a shift register 13 and a color conversion table 14 as parts for transferring the data which are read from the display memory 2 to the display unit 3 The display memory 2 is formed by four RAMs for storing color signals R, B and G and a luminance signal I respectively, while the display data latch 12 and the shift register 13 are also formed by four latches and four shift registers which are provided in parallel with each other, in response thereto.

Output data (8 by 4 bits in total) from the respective RAMs of the display memory 2 are supplied to corresponding data inputs D of the display data latch 12 respectively. The output data from the display memory 2 are latched by the display data latch 12 in response to the clock CC which is supplied to a timing input T of the display data latch 12, as shown in a timing chart of FIG. 20. Output data from the display data latch 12 are supplied to a data input D of the shift register 13. The shift register 13 loads the output data of the display data latch 12 in response to a load signal PL which is supplied to its load input LD, and serially outputs the as-loaded data bitwise in response to a dot clock DS received in its timing input T, as shown in FIG. 20. Since the shift register 13 is formed by four registers, 4-bit (1 bit by 4) data are successively outputted. A 1-dot pixel is formed by the 4-bit data. Namely, $2^4$=16 colors can be displayed every pixel.

The color conversion table 14 receives the 4-bit data from the shift register 13 in its address input A, and converts the same to 6-bit color image data VD to output the same. Namely, color data for $2^6$=64 colors are previously set and 16 colors to be displayed are previously selected therefrom in the color conversion table 14, which selects/outputs the as-selected 16 colors in accordance with 4-bit address input. This color conversion table 14 increases the number of colors (color selection range) which can be displayed on the display unit 3

In the conventional display controller 1 having the aforementioned structure, horizontal scanning lines repeating the same display are fixed in all frames in the mode of vertically enlarging the screen, as shown in FIG. 21. When an oblique thin line is vertically enlarged, therefore, every frame presents a screen shown in FIG. 22 with steps appearing in the oblique line to cause indented appearance.

In order to solve this problem, there has been proposed a technique of passing an output from a color conversion table 14 through two line memories 51 and 52 which are connected in series with each other and operating outputs for two lines from the line memories 51 and 52 in an arithmetic unit 53 for smoothing the image, as shown in FIG. 23. However, this method requires the line memories 51 and 52 and the arithmetic unit 53, leading to complicatedness of the unit structure.

SUMMARY OF THE INVENTION

According to a first aspect of the present invention, a display controller for executing control for making a display unit display information in response to data which is stored in a display memory comprises address generation means for generating an address for addressing the display memory, and data transfer means for transferring data which is read from the display memory in accordance with the address from the address generation means to the display unit, and the address generation means comprises means for generating a reference signal having one cycle corresponding to one horizontal scanning period of the display unit, data skipping means for inactivating the reference signal once every n horizontal scanning lines thereby data-skipping the reference signal, data skipping timing change means for displacing data skipping timing by the data skipping means between odd and even frames by one horizontal scanning line, and address formation means for forming the address every horizontal scanning line in response to the reference signal which is data-skipped by the data skipping means at timing which is changed by the data skipping timing change means.

According to a second aspect of the present invention, a display controller for executing control for making a display unit display information in response to data which is stored in a display memory comprises address generation means for generating an address for addressing the display memory, and data transfer means for transferring data which is read from the display memory in accordance with the address from the address generation means to the display unit, and the address generation means comprises means for generating a reference signal having one cycle corresponding to one horizontal scanning period of the display unit, data skipping means for inactivating the reference signal once every n horizontal scanning lines thereby data-skipping the reference signal, data skipping timing change means for displacing data skipping timing by the data skipping means between odd and even frames by one horizontal scanning line while changing the same in accordance with a prescribed rule in response to frame progress, and address formation means for forming the address every horizontal scanning line in response to the reference signal which is data-skipped by the data skipping means at timing which is changed by the data skipping timing change means.

According to the first or second aspect of the present invention, the data transfer means preferably comprises data change means for making prescribed change on the data which is read from the display memory in response to data skipping timing of the data skipping means.

According to the first or second aspect of the present invention, the data transfer means preferably comprises first and second color conversion tables for reading color image data in accordance with a prescribed rule through an address of the data which is read from the display memory, and selection means for selecting either one of the first and second color conversion tables in response to data skipping timing of the data skipping means.

The data skipping timing change means in the display controller according to the first aspect of the present invention operates to displace the data skipping timing of the data skipping means between odd and even frames by one horizontal scanning line. The address formation means forms an address every horizontal scanning line in response to the reference signal which is data-skipped by the data skipping means at timing which is changed by the data skipping timing change means. When the same address is formed in two horizontal scanning lines in response to data skipping of the reference signal to display the same data, therefore, display portions of the same data are alternately displaced by one horizontal scanning line between odd and even frames. Thus, it is possible to obtain a relatively smooth display image also in a mode of vertically enlarging the image.

The data skipping timing change means in the display controller according to the second aspect of the present invention operates to displace the data skipping timing of the data skipping means between odd and even frames by one horizontal scanning line while changing the same by a prescribed rule in response to frame progress. The address formation means forms an address every horizontal scanning line in response to the reference signal which is data-skipped by the data skipping means at timing which is changed by the data skipping timing change means. When the same address is formed in two horizontal scanning lines in response to data skipping of the reference signal to display the same data, therefore, display portions of the same image are alternately displaced by one horizontal scanning line between odd and even frames, while the display portions of the same image are successively changed by the prescribed rule in response to frame progress. Thus, it is possible to obtain a smoother display image in a mode of vertically enlarging the image as compared with that according to the first aspect of the present invention.

The data change means in the display controller according to the first or second aspect of the present invention operates to make prescribed change on the data which is read from the display memory in response to data skipping timing of the data skipping means. Therefore, it is possible to make change such as that for displaying a color having relatively low chromaticity in response to the data skipping timing of the data skipping means, so that an enlarged portion is not conspicuous in vertical enlargement of an image.

The selection means in the display controller according to the first or second aspect of the present invention operates to select either one of the first and second color conversion tables in response to data skipping timing of the data skipping means. When colors or ordinary and relatively low chromaticity levels, for example, are previously set in the first and second color conversion tables respectively so that the first color conversion table is selected in no data skipping and the second color conversion table is selected in data skipping, therefore, it is possible to display portions displaying the same image by skipping in a pale color, so that the enlarged portion is not conspicuous in vertical enlargement of the image.

The present invention having the aforementioned structure attains the following effects:

The display controller according to the first aspect of the present invention comprises the data skipping timing change means for displaying the data skipping timing by the data skipping means between odd and even frames by one horizontal scanning line, whereby positions of inserted lines are changed between the odd and even frames so that smooth image display can be obtained with no indentation in vertical screen enlargement.

The display controller according to the second aspect of the present invention comprises the data skipping timing change means for displaying the data skipping timing by the data skipping means between odd and even frames by one horizontal scanning line while changing the data skipping timing by a prescribed rule in response to frame progress, whereby positions of inserted lines are changed between the odd and even frames in accordance with the prescribed rule in response to frame progress, so that smoother image display can be obtained with no indentation in vertical enlargement of the screen as compared with that in the display controller according to the first aspect of the present invention.

In the display controller according to the first or second aspect of the present invention, the data transfer means comprises the data change means for making prescribed change on the data which is read from the display memory in response to data skipping timing of the data skipping means, whereby it is possible to carry out color display with low chromaticity in response to the data skipping timing, i.e., in response to inserted lines, to obtain an enlarged image having smooth color change.

In the display controller according to the first or second aspect of the present invention, the data transfer means comprises the selection means for selecting either one of the first and second color conversion tables in response to data skipping timing of the data skipping means, whereby it is possible to carry out color display with low chromaticity by setting color data of ordinary and low chromaticity levels in the first and second color conversion tables respectively and selecting the second color conversion table in response to the data skipping timing, i.e., in response to inserted lines, for obtaining an enlarged image having smooth color change in vertical screen enlargement.

Accordingly, an object of the present invention is to provide a display controller which can obtain smooth image display with no indentation also in a mode of vertically enlarging the screen, with a relatively simple unit structure.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 5 illustrates a state of lines which are inserted in a case of vertically enlarging screen display by the display controller shown in FIG. 1;

FIG. 11 illustrates a state of lines which are inserted in a case of vertically enlarging screen display by the display controller shown in FIG. 9;

FIG. 13 is a block diagram showing a conventional display controller;

FIG. 18 is a block diagram showing a head address generation circuit provided in the display controller shown in FIG. 13 in detail;

FIG. 19 illustrates addresses which are generated by an address counter provided in the display controller shown in FIG. 13;

FIG. 21 illustrates a state of lines which are inserted in a case of vertically enlarging screen display by the display controller shown in FIG. 13;

DESCRIPTION OF THE PREFERRED EMBODIMENTS

<First Embodiment>

Figure 1:
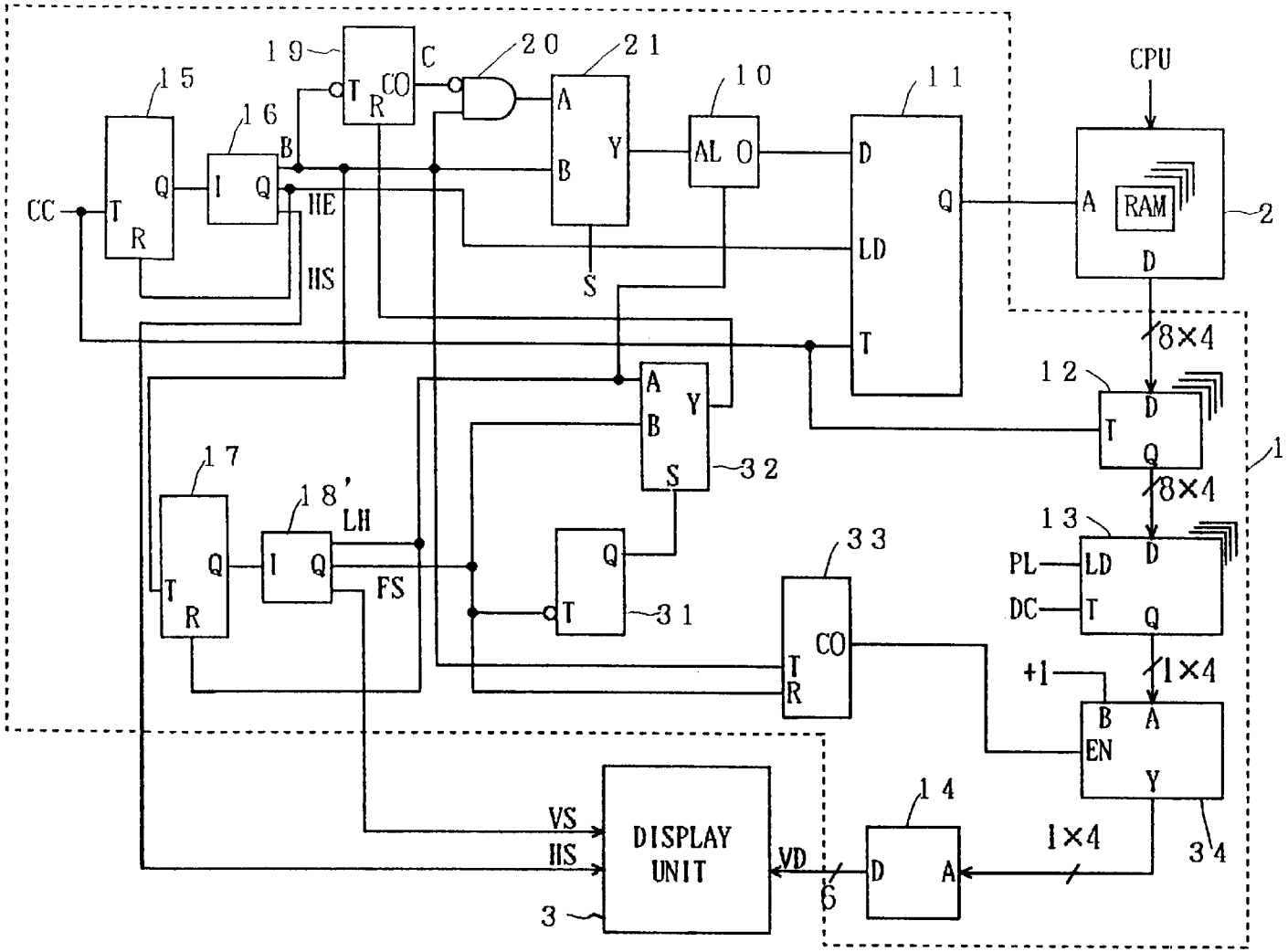
FIG. 1 is a block diagram showing a display controller according to a first embodiment of the present invention.
Figures 2A, 2B, 2C, 2D, 2E, 2F, 2G, 2H, 2I:
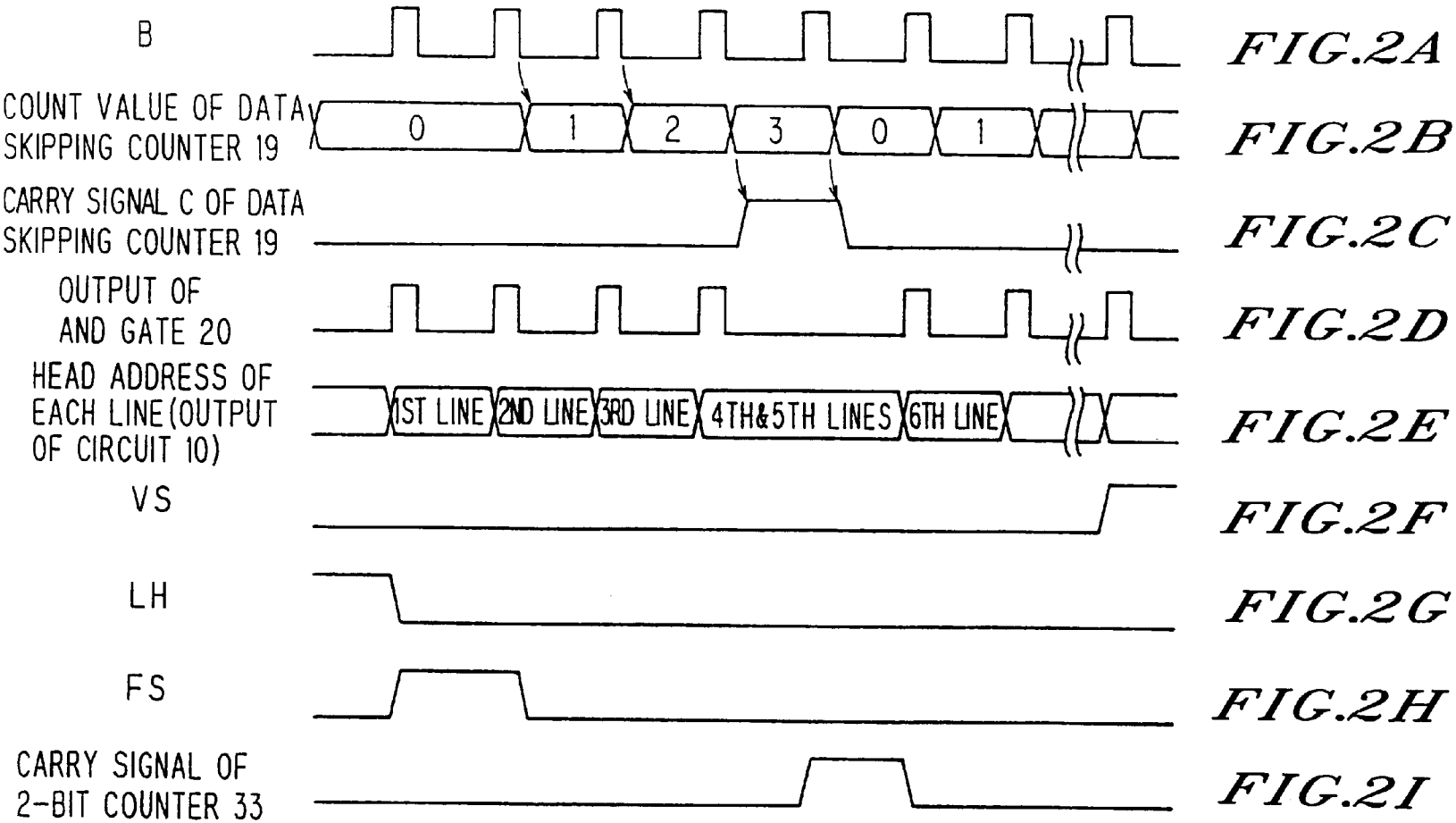
FIG. 2 is a timing chart showing operation of the display controller shown in FIG. 1.
Figures 2J, 2K, 2L, 2M, 2N, 2O, 2P, 2Q, 2R:
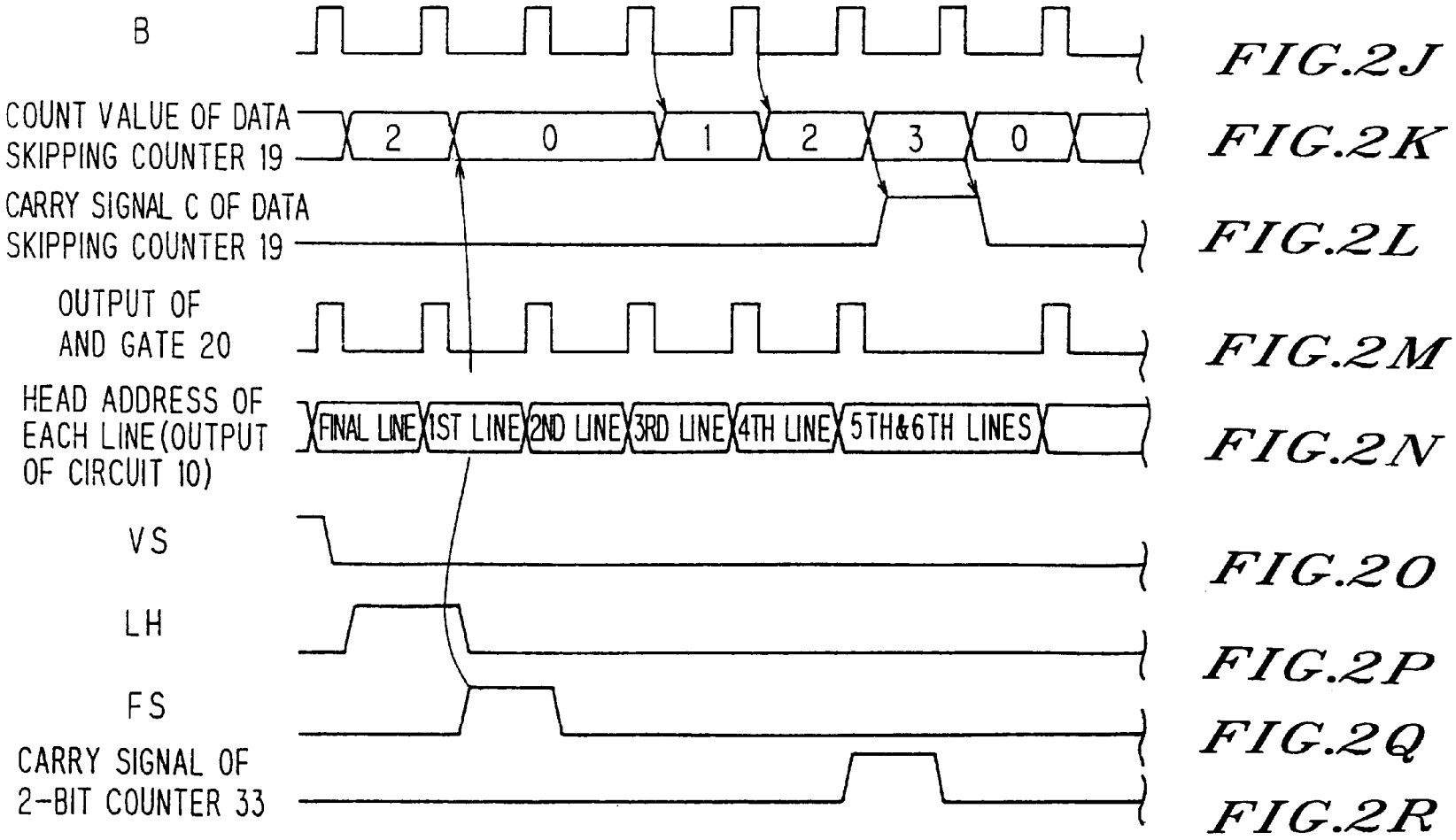

FIG. 1 is a block diagram showing a display controller 1 according to a first embodiment of the present invention. This display controller 1 is different from the conventional one shown in FIG. 13 in the following three points: First, a vertical timing generation circuit 18' is provided in place of the vertical timing generation circuit 18 shown in FIG. 13. This vertical timing generation circuit 18' generates a signal FS shown in a timing chart of FIG. 2, in addition to a vertical synchronizing signal VS and a signal LH indicating the final line of one frame, which are similar to those of the conventional display controller 1. The signal FS indicates starting of each frame.

Figure 3:
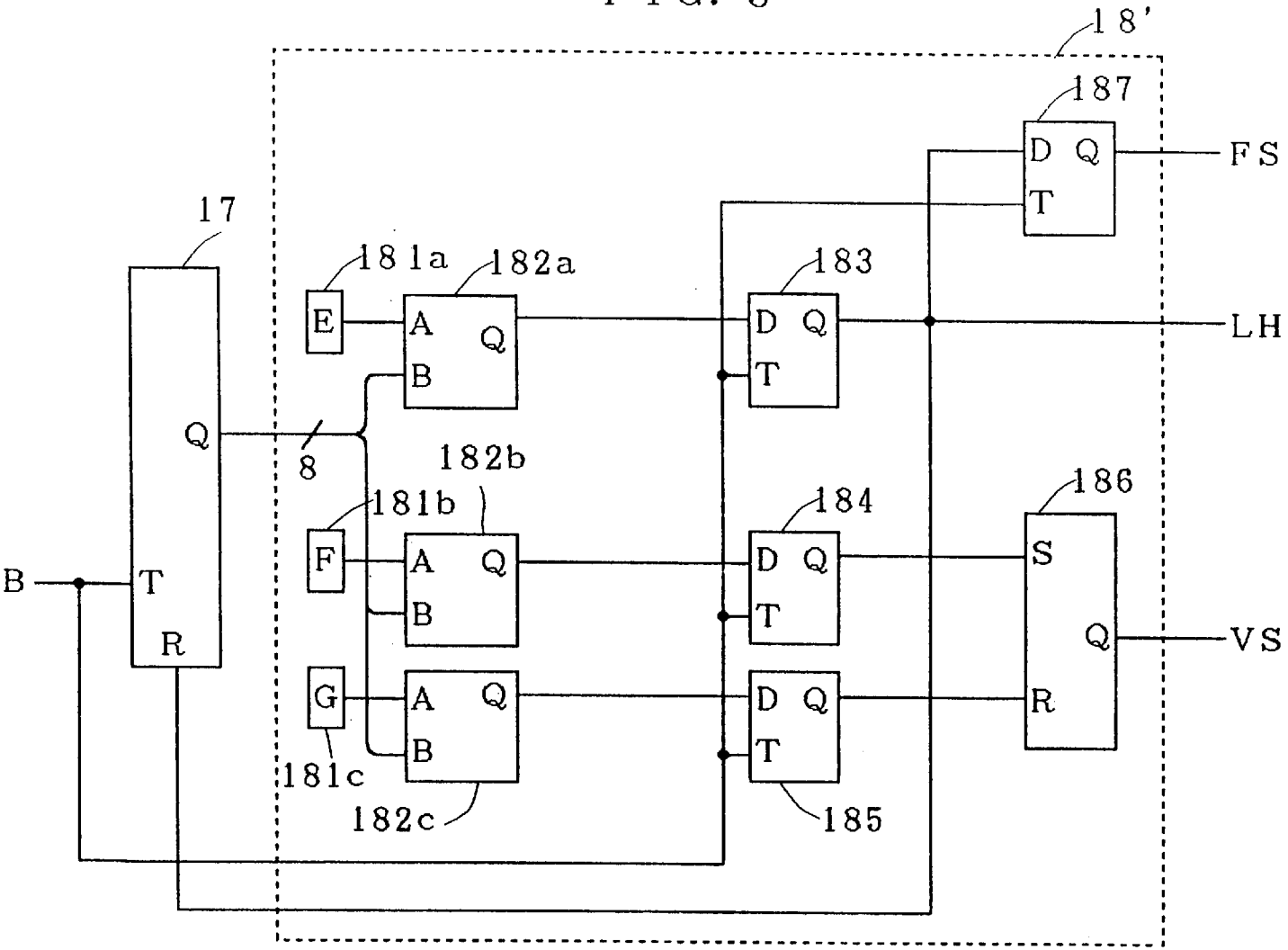
FIG. 3 is a block diagram showing a vertical timing generation circuit provided in the display controller shown FIG. 1 in detail.
Figure 17:
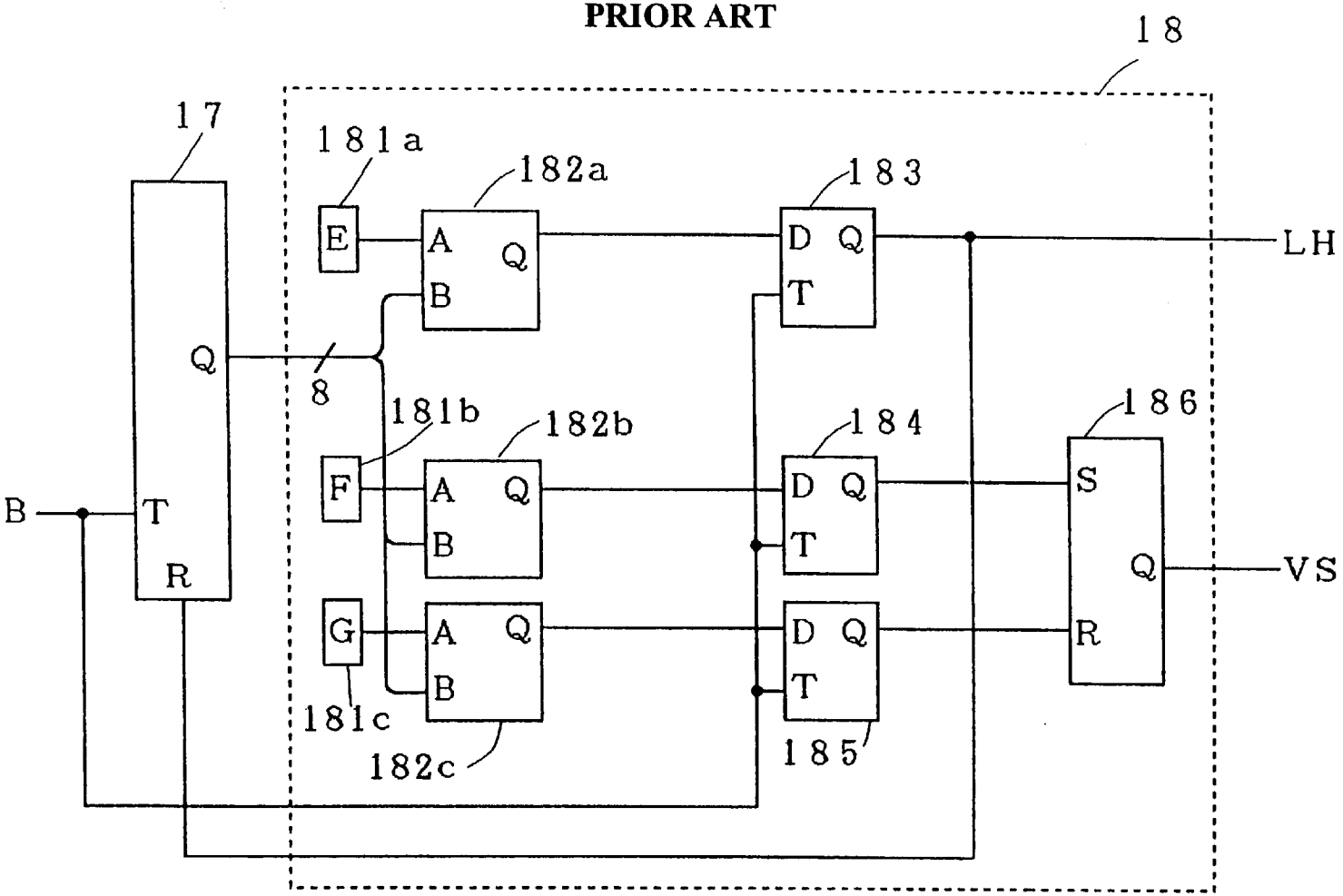
FIG. 17 PRIOR ART
FIG. 17 is a block diagram showing a vertical timing generation circuit provided in the display controller shown in FIG. 13 in detail.
Figures 20A, 20B, 20C, 20D, 20E, 20F, 20G:
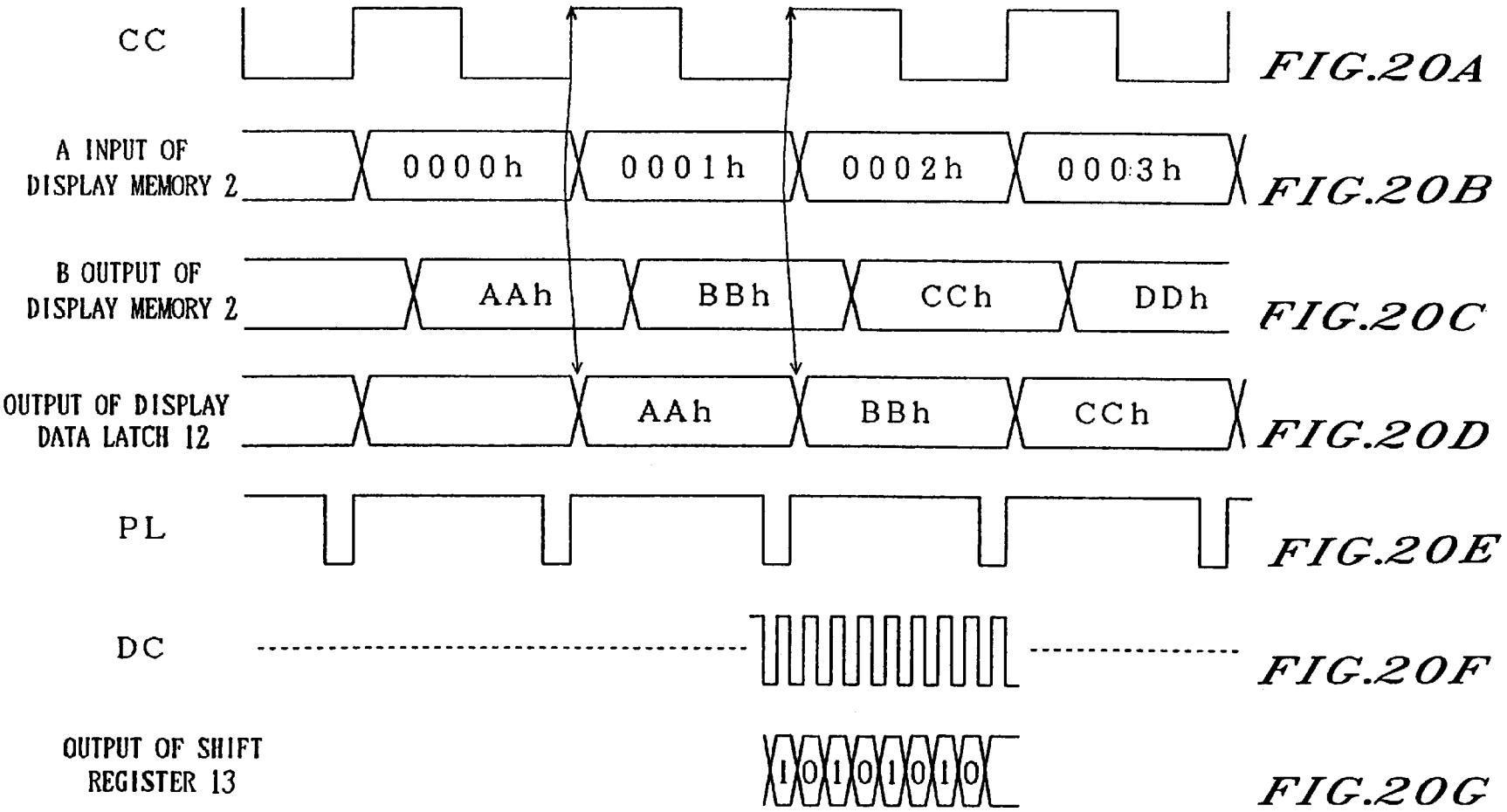
FIG. 20 is a timing chart showing operation of the display controller shown in FIG. 13.
Figure 22:
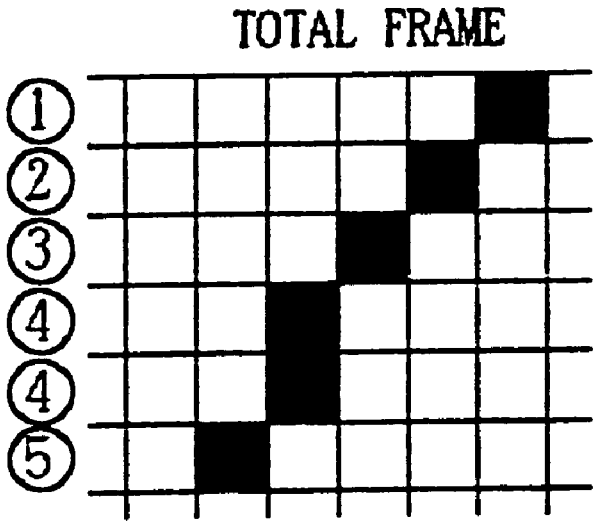
FIG. 22 PRIOR ART
FIG. 22 illustrates a state of image display in a case of vertically enlarging/displaying an oblique thin line by the display controller shown in FIG. 13.
Figure 23:
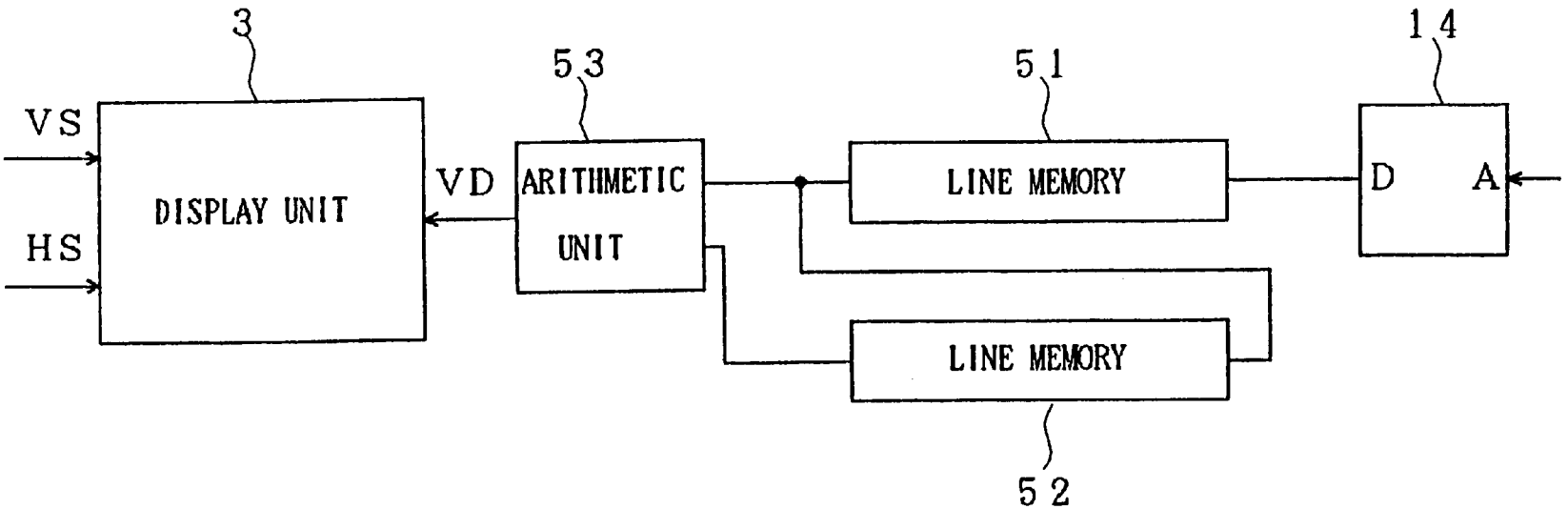
FIG. 23 PRIOR ART
FIG. 23 illustrates a conventional technique for removing indentation of an image which is vertically enlarged/displayed.

FIG. 3 is a block diagram showing the vertical timing generation circuit 18' in detail. This vertical timing generation circuit 18' has a structure which is obtained by adding a D flip-flop 187 to that of the vertical timing generation circuit 18 shown in FIG. 17. The D flip-flop 187 receives the signal LH which is outputted from a D flip-flop 183 in its data input D, while receiving a signal B from a horizontal timing generation circuit 16 in its timing input T. Thus, the signal FS is derived from the D flip-flop 187. Other structure and operation of the vertical timing generation circuit 18' are similar to those of the vertical timing generation circuit 18 shown in FIG. 17.

The display controller 1 shown in FIG. 1 is different from the conventional display controller 1 shown in FIG. 13 in such a second point that a T flip-flop 31 and a selector 32 are provided for switching a signal for resetting a data skipping counter 19 every frame. The signal FS from the vertical timing generation circuit 18' is supplied to a negative logic timing input T of the T flip-flop 31, whose output is supplied to a selection input S of the selector 32. The selector 32 is supplied with the signals LH and FS from the vertical timing generation circuit 18' in its A and B inputs respectively. In response to the output of the T flip-flop 31, the selector 32 switches signals of its A and B inputs to supply the same to a reset input R of the data skipping counter 19.

The display controller 1 shown in FIG. 1 is different from the conventional display controller 1 shown in FIG. 13 in such a third point that a 2-bit counter 33 and an adder 34 are provided as means for making prescribed change on data which are read from a display memory 2 in response to data skipping timing by the data skipping counter 19. The 2-bit counter 33 is supplied with the signals B and FS from the horizontal and vertical timing generation circuits 16 and 18' in its timing and reset inputs T and R respectively. Similarly to the data skipping counter 19, the 2-bit counter 33 outputs a carry signal every time its count value reaches 3, so that this carry signal is supplied to an enable input EN of the adder 34. The adder 34 is further supplied with a 4-bit signal from a shift register 13 and a +1 input for addition in its A and B inputs respectively. The adder 34 adds 1 to output data from the shift register 13 every time a carry signal is outputted from the 2-bit counter 33, to output the result.

Except the aforementioned three points, the display controller 1 shown in FIG. 1 is similar in structure to the conventional display controller 1 shown in FIG. 13.

Figures 4A, 4B, 4C, 4D, 4E, 4F:
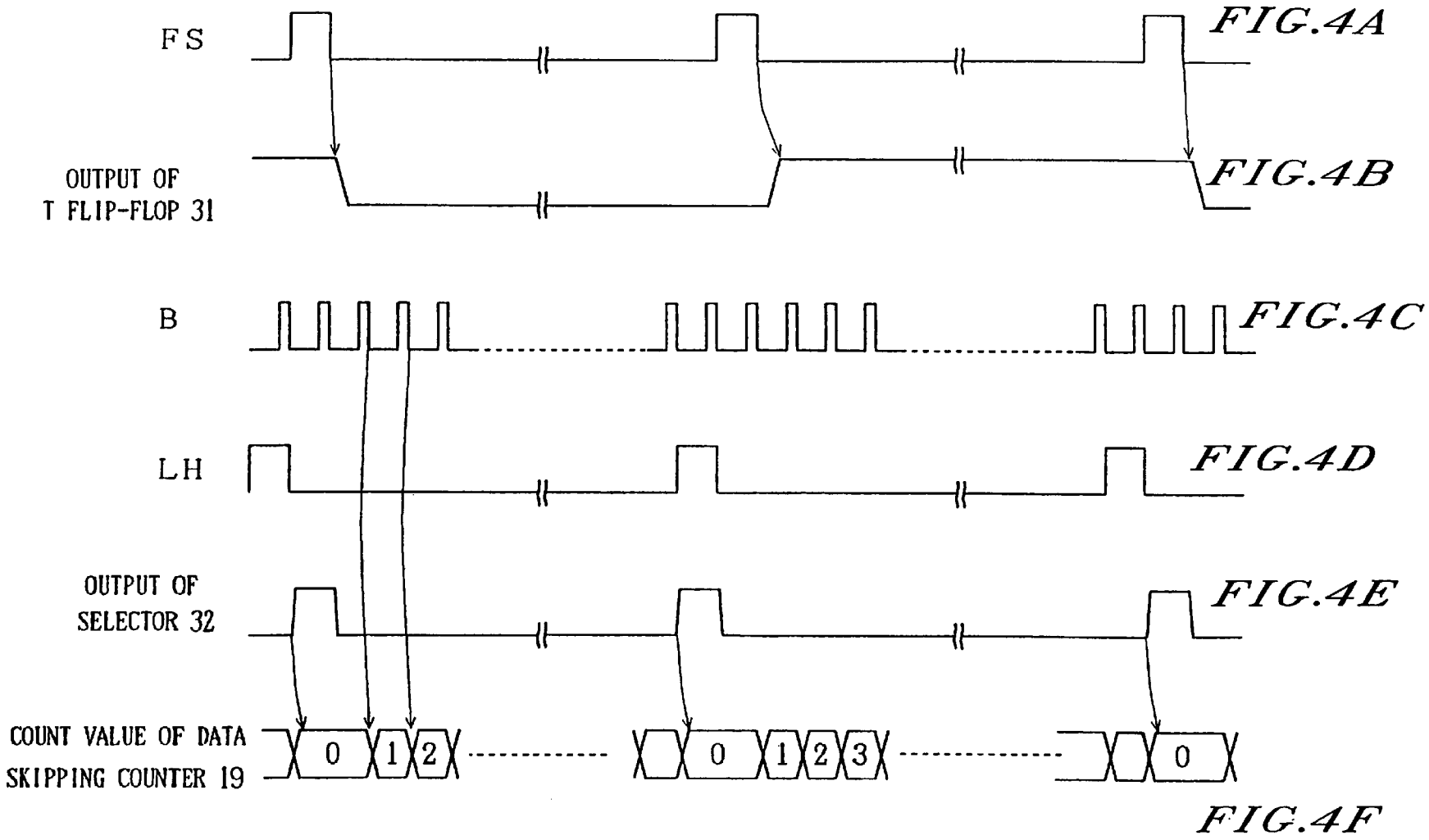
FIG. 4 is a timing chart showing operation of the display controller shown in FIG. 1.

When a selection signal S which is supplied to a selector 21 indicates no vertical screen enlargement, the selector 21 selects its B input. In this mode, a head address generation circuit 10 generates a head address every signal B from the horizontal generation circuit 16, i.e., every horizontal scanning line similarly to that in the conventional display controller 1 shown in FIG. 13, whereby an operation for reading data from the display memory 2 is similar to that of the conventional display controller 1 shown in FIG. 13. When the selection signal S which is supplied to the selector 21 indicates vertical screen enlargement, on the other hand, the selector 21 selects its A input. An operation in this mode is as follows:

An output of the T flip-flop 31 is changed every frame in response to the signal FS from the vertical timing generation circuit 18', as shown in a timing chart of FIG. 4. In response to this change, the selector 32 alternately selects the signals LH and FS which are received in the A and B inputs every frame, as shown in the timing chart of FIG. 4. The data skipping counter 19 is set by the output of the selector 32.

In a frame where the selector 32 outputs the signal LH, an operation similar to that of the conventional display controller 1 is carried out. Namely, the head address generation circuit 10 outputs the same head address for fourth and fifth horizontal scanning lines, as described above in relation to the conventional display controller 1 shown in FIG. 13. This operation is shown in the upper half of the timing chart in FIG. 2. In this frame (e.g., an odd frame), the head address is doubled once every four lines, so that an image of one frame is vertically enlarged to ⅔ times, as described above in relation to the conventional display controller 1.

In a frame (e.g., an even frame) where the selector 32 outputs the signal FS, on the other hand, the data skipping counter 19 is reset in a delay for one horizontal cycle. This is because the signal FS is delayed by one cycle of the signal B, i.e., one horizontal cycle, from the signal LH. Therefore, the carry signal C is generated from the data skipping counter 19 also in a delay for one horizontal cycle as compared with the odd frame, whereby an AND gate 20 data-skips the signal B at timing in a delay by one horizontal cycle. This operation is shown in the lower half of the timing chart in FIG. 2. In such an even frame, the head address generation circuit 10 outputs the same head address for fifth and sixth horizontal scanning lines. Thereafter the head address is doubled once every four lines, similarly to the odd frame. Thus, the image is vertically enlarged to ⅔ times also in the even frame.

The aforementioned operation is alternately carried out in the odd and even frames. FIG. 5 shows this state. In the odd frames, original images of the fourth lines are repeatedly displayed in the fourth and fifth scanning lines, while original images of the fifth lines are repeatedly displayed in the fifth and sixth horizontal scanning lines in even frames.

The adder 2 operates in response to a carry output from the 2-bit counter 33. The 2-bit counter 33 is in common with the data skipping counter 19, which is also a 2-bit counter, in a point that the signal B is supplied in its timing input T. While the data skipping counter 19 is alternately reset by the outputs of the selector 32, i.e., the signals LH and FS, however, the 2-bit counter 33 is regularly reset by the signal FS. Therefore, the carry output of the 2-bit counter 33 is regularly outputted at the same timing, dissimilarly to the data skipping counter 19. Namely, the carry output of the 2-bit counter 33 is outputted at timing responsive to a later one of two lines having doubled head addresses in an odd frame and at that responsive to a former one of two lines having doubled head addresses in an even frame, as shown in the timing chart of FIG. 2. Referring to FIG. 5, each portion enclosed with a rectangle corresponds to this timing.

In response to the carry signal received from the 2-bit counter 33, the adder 34 performs +1 conversion on 4-bit data received from the shift register 13. Table 1 shows this state.

TABLE 1

| Ordinary Display Data | +1 Conversion |
|---|---|
| 0000 | 0001 |
| 0001 | 0010 |
| 0010 | 0011 |
| 0011 | 0100 |
| 0100 | 0101 |
| 0101 | 0110 |
| 0110 | 0111 |

TABLE 1-continued

| Ordinary Display Data | +1 Conversion |
|---|---|
| 0111 | 1000 |
| 1000 | 1001 |
| 1001 | 1010 |
| 1010 | 1011 |
| 1011 | 1100 |
| 1100 | 1101 |
| 1101 | 1110 |
| 1110 | 1111 |
| 1111 | 0000 |

It is assumed here that data shown in Table 2 are previously set in the color conversion table 14.

TABLE 2

| Address of Color Conversion Table 14 | Color Data |
|---|---|
| 0000 | Black |
| 0001 | Pale Black |
| 0010 | " |
| 0011 | " |
| 0100 | " |
| 0101 | " |
| 0110 | " |
| 0111 | Grey |
| 1000 | " |
| 1001 | " |
| 1010 | " |
| 1011 | " |
| 1100 | " |
| 1101 | " |
| 1110 | White |
| 1111 | Light White |

In this case, colors having smaller chromaticity levels than ordinary ones are displayed through the +1 conversion by the adder 34. Referring to FIG. 5, the same images (original images of the fourth lines) are displayed on the fourth and fifth horizontal scanning lines in the odd frames, while colors having smaller chromaticity levels than those in the fourth horizontal scanning lines after enlargement are displayed in the fifth horizontal scanning lines after enlargement in this case. In the even frames, on the other hand, the same images (original images of the fifth lines) are displayed on the fifth and sixth horizontal scanning lines, while colors having smaller chromaticity levels than those in the sixth horizontal scanning lines after enlargement are displayed in the fifth horizontal scanning lines after enlargement in this case. In images having frame frequencies of about 60 Hz, the fifth horizontal scanning lines present colors in mixture of those in the fourth and sixth horizontal scanning lines.

Figure 6A:
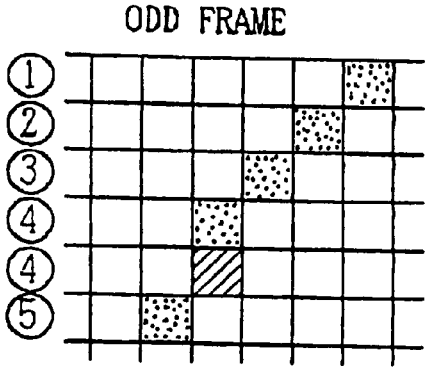
FIG. 6 illustrates states of image display in a case of vertically enlarging/displaying an oblique thin line by the display controller shown in FIG. 1.
Figure 6B:
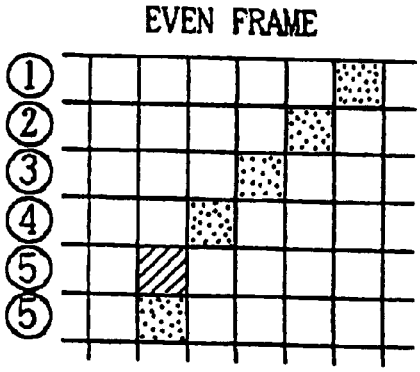

FIG. 6 shows states of an image which is displayed on the display unit 3 when an oblique thin line is vertically enlarged by the display controller 1 according to this embodiment. Slant portions show portions of color display with small chromaticity levels. Since positions of image repeating lines are alternately changed between odd and even frames and color display with smaller chromaticity levels than ordinary ones is carried out in the image repeating lines, indentation of the image is blurred and a smooth image is obtained.

<Modifications>

Figure 7:
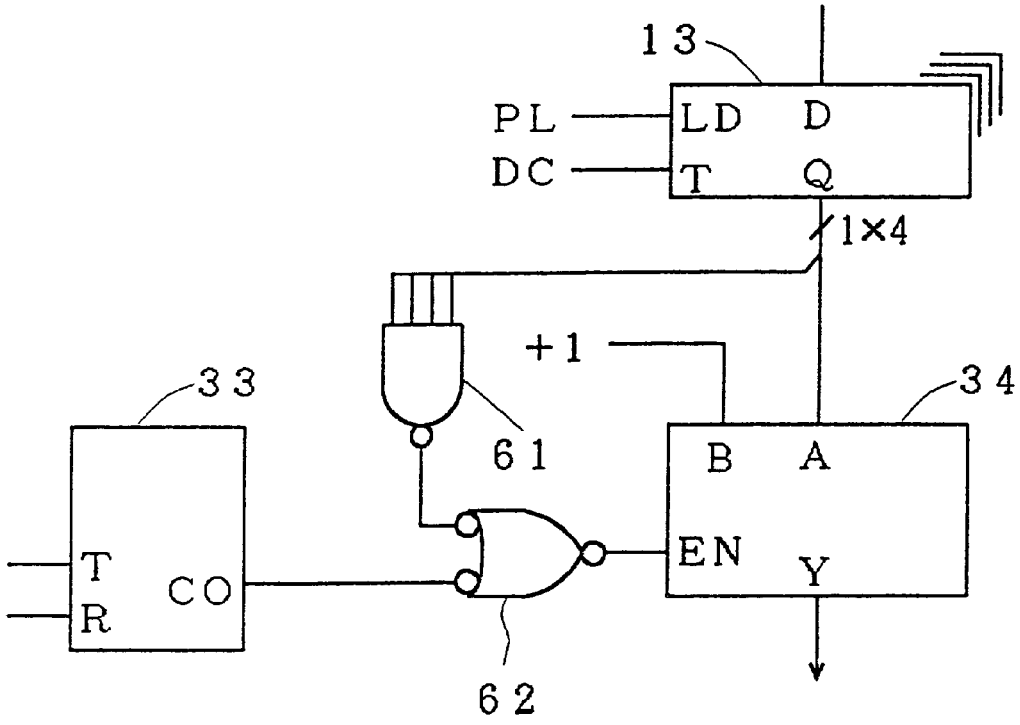
FIG. 7 is a block diagram showing a first modification of the display controller according to the first embodiment of the present invention.

FIG. 7 is a block diagram showing a modification of the first embodiment. According to this modification, a NAND gate 61 and a NOR gate 62 are provided as means for inhibiting +1 conversion by an adder 34 when output data from a shift register 13 is "1111". The 4-bit output of the shift register 13 is supplied to an input of the NAND gate 61, whose output is supplied to a negative logic input of the NOR gate 62. A carry output of a 2-bit counter 33 is supplied to another negative logic input of the NOR gate 62, whose output is supplied to an enable input EN of the adder 34. According to this structure, no +1 conversion is carried out by the adder 34 when the shift register 13 outputs "1111". Table 3 shows outputs of the adder 34.

TABLE 3

| Ordinary Display Data | +1 Conversion |
|---|---|
| 0000 | 0001 |
| 0001 | 0010 |
| 0010 | 0011 |
| 0011 | 0100 |
| 0100 | 0101 |
| 0101 | 0110 |
| 0110 | 0111 |
| 0111 | 1000 |
| 1000 | 1001 |
| 1001 | 1010 |
| 1010 | 1011 |
| 1011 | 1100 |
| 1100 | 1101 |
| 1101 | 1110 |
| 1110 | 1111 |
| 1111 | 1111 |

According to this modification, it is possible to avoid an error of converting output data of the shift register 13 indicating light white to that indicating black when a color conversion table 14 has set data shown in Table 2. If this error is not avoided, color display having high chromaticity is disadvantageously carried out in enlarged portions of the image.

Figure 8:
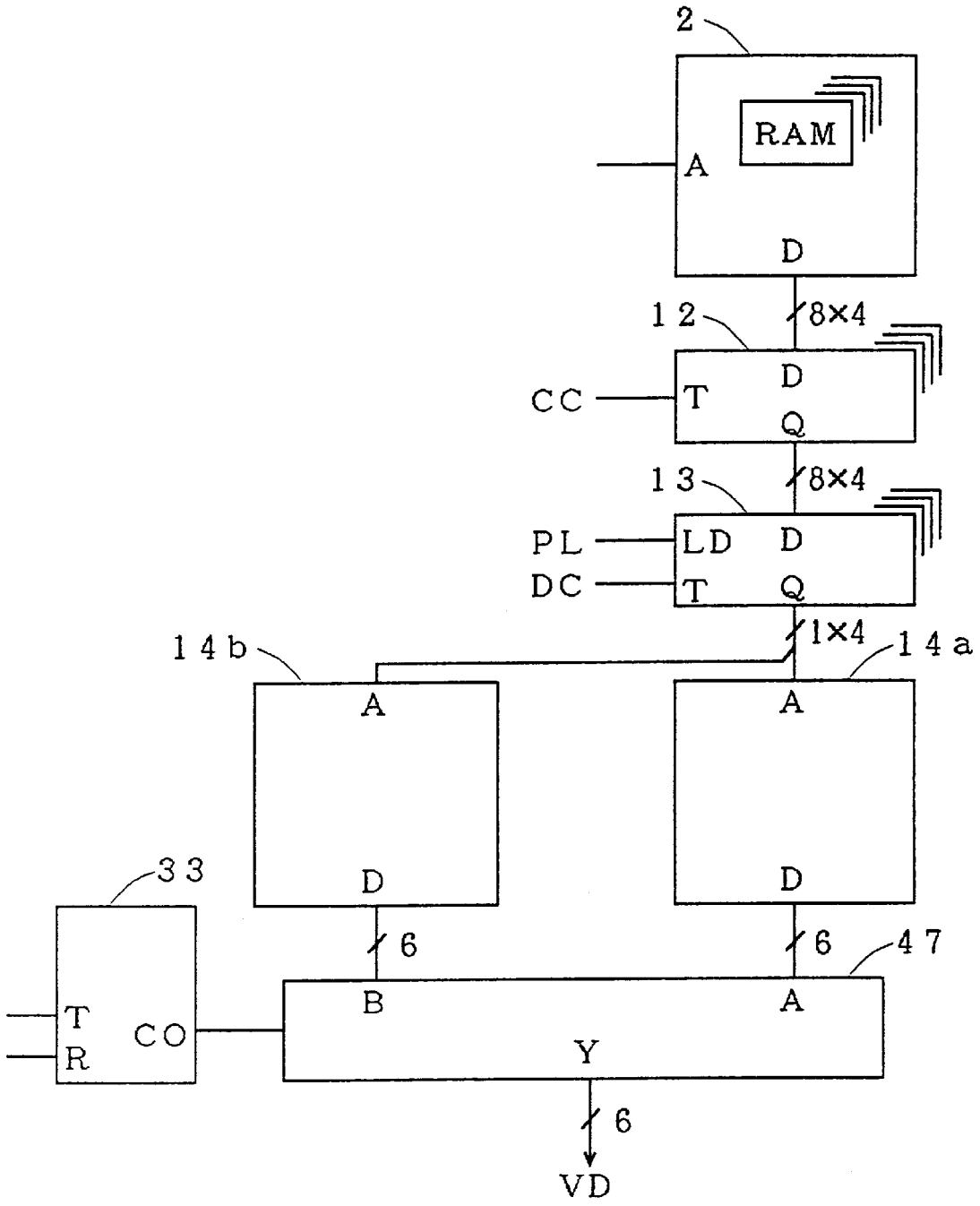
FIG. 8 is a block diagram showing a second modification of the display controller according to the first embodiment of the present invention.

FIG. 8 is a block diagram showing another modification of the first embodiment. According to this modification, first and second color conversion tables 14*a* and 14*b* and a selector 47 are provided in place of the adder 34 shown in FIG. 1. Color data shown in Table 4 may be set in the first and second color conversion tables 14*a* and 14*b*, for example:

TABLE 4

| Address | Color Data in Color Conversion Table 14a | Color Data in Color Conversion Table 14b |
|---|---|---|
| 0000 | Black | Pale Black |
| 0001 | Blue | Pale Blue |
| 0010 | Green | Pale Green |
| 0011 | Cyan | Pale Cyan |
| 0100 | Red | Pale Red |
| 0101 | Magenta | Pale Magenta |
| 0110 | Brown | Pale Brown |
| 0111 | White | Pale White |
| 1000 | Grey | Pale Grey |
| 1001 | Light Blue | Pale Light Blue |
| 1010 | Yellow-Green | Pale Yellow-Green |
| 1011 | Light Cyan | Pale Light Cyan |
| 1100 | Light Red | Pale Light Red |
| 1101 | Light Magenta | Pale Light Magenta |
| 1110 | Yellow | Pale Yellow |
| 1111 | Light White | Pale Light White |

4-bit data from a shift register 13 are supplied in parallel with each other to the first and second color conversion tables 14*a* and 14*b*. Output data from the first and second color conversion tables 14*a* and 14*b* are supplied to A and B inputs of the selector 47 respectively. The selector 47 selects its A input, i.e., the output data of the first color conversion table 14*a*, when no carry output is received from a 2-bit counter 33, while selecting its B input, i.e., the output data of the second color conversion table 14*b*, when a carry output is received from the 2-bit counter 33. Color image data VD outputted from the selector 47 are supplied to a display unit 3.

According to this modification, color data which are set in the second color conversion table 14*b* have lower chromaticity levels than those set in the first color conversion table 14*a*. The color data having lower chromaticity levels which are set in the second color conversion table 14*b* are selected in response to the carry output from the 2-bit counter 33. Thus, it is possible to attain an effect which is similar to that in a case of selecting colors having low chromaticity levels by the adder 34 provided in the first embodiment.

<Second Embodiment>

Figure 9:
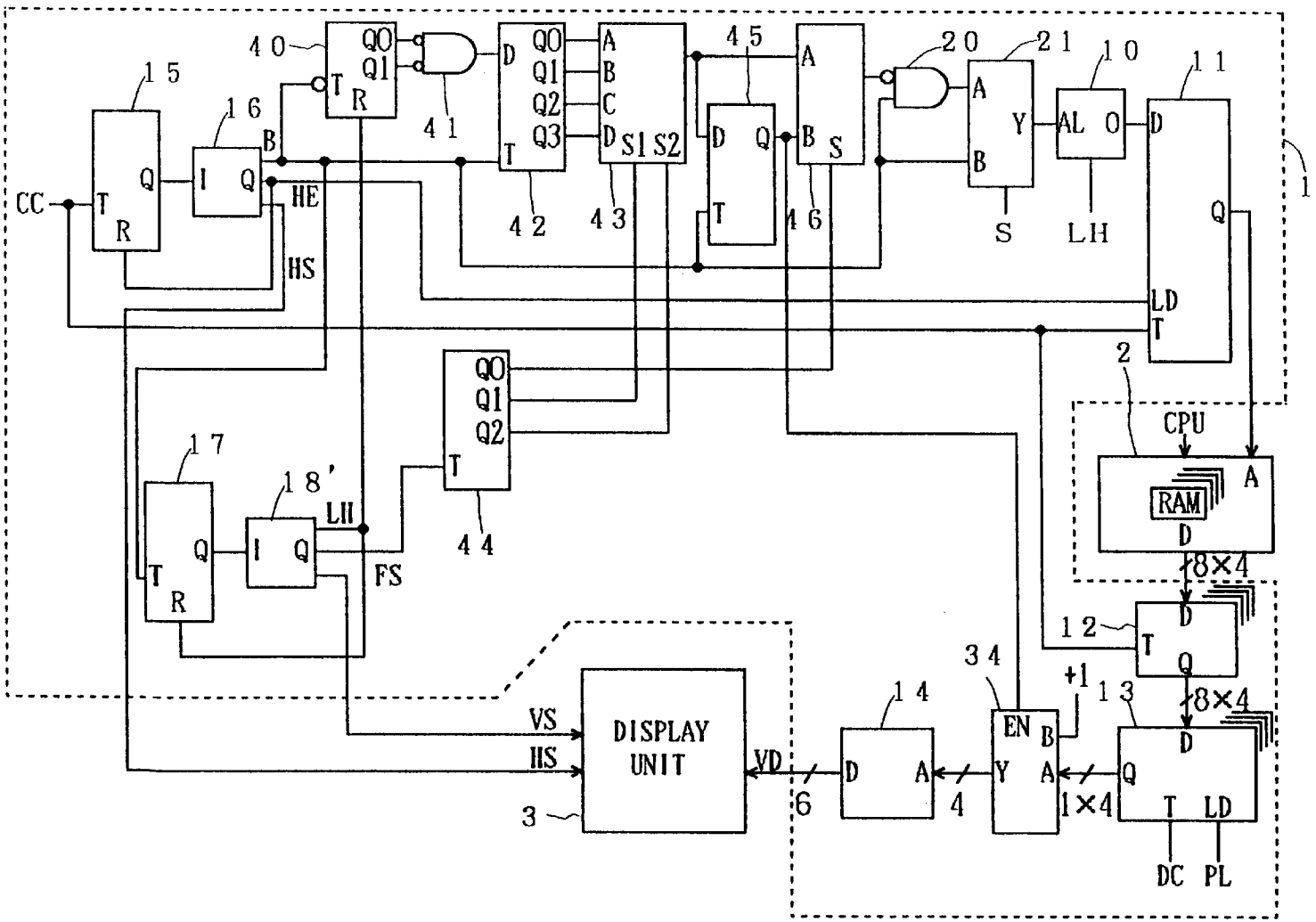
FIG. 9 is a block diagram showing a display controller according to a second embodiment of the present invention.

FIG. 9 is a block diagram showing a display controller 1 according to a second embodiment of the present invention. The display controller 1 according to the second embodiment is different from the display controller 1 according to the first embodiment shown in FIG. 1 in the following point: A 2-bit counter 40, an AND gate 41, a shift register 42, a selector 43, a 3-bit counter 44, a D flip-flop 45 and a selector 46 are provided in place of the data skipping counter 19, the T flip-flop 31 and the selector 32 shown in FIG. 1, as means for displacing timing for data-skipping a signal B between odd and even frames by one horizontal scanning line while changing the data skipping timing by a prescribed rule in response to frame progress. Further, an enable input EN of an adder 34 is supplied with an output of the D flip-flop 45.

The 3-bit counter 44 receives a signal FS from a vertical timing generation circuit 18' in its timing input T, to carry out a counting operation. The least significant bit output (Q0 output) of the counter 44 is supplied to a selection input S of the selector 46, while upper two bit outputs (Q1 and Q2 outputs) are supplied to first and second selection inputs S1 and S2 of the selector 43 respectively. The 2-bit counter 40 is supplied in its timing and reset inputs T and R with a signal B from a horizontal timing generation circuit 16 and a signal LH from the vertical timing generation circuit 18' respectively. A 2-bit output of the 2-bit counter 40 is supplied to both negative logic inputs of the AND gate 41, whose output is supplied to a data input D of the shift register 42. The shift register 42 is supplied in its timing input T with the signal B from the horizontal timing generation circuit 16. Outputs Q0 to Q3 of the shift register 42 are supplied to inputs A to D of the selector 43 respectively. The output of the selector 43 is directly supplied to an A input of the selector 46, while being supplied to a B input of the selector 46 through the D flip-flop 45. The D flip-flop 45 is supplied in its timing input T with the signal B from the horizontal timing generation circuit 16. The output of the selector 46 is supplied to a negative logic input of the AND gate 20. Other structure of this embodiment is similar to that of the first embodiment shown in FIG. 1.

Figures 10A, 10B, 10C, 10D, 10E, 10F, 10G, 10H, 10I, 10J, 10K, 10L, 10M:
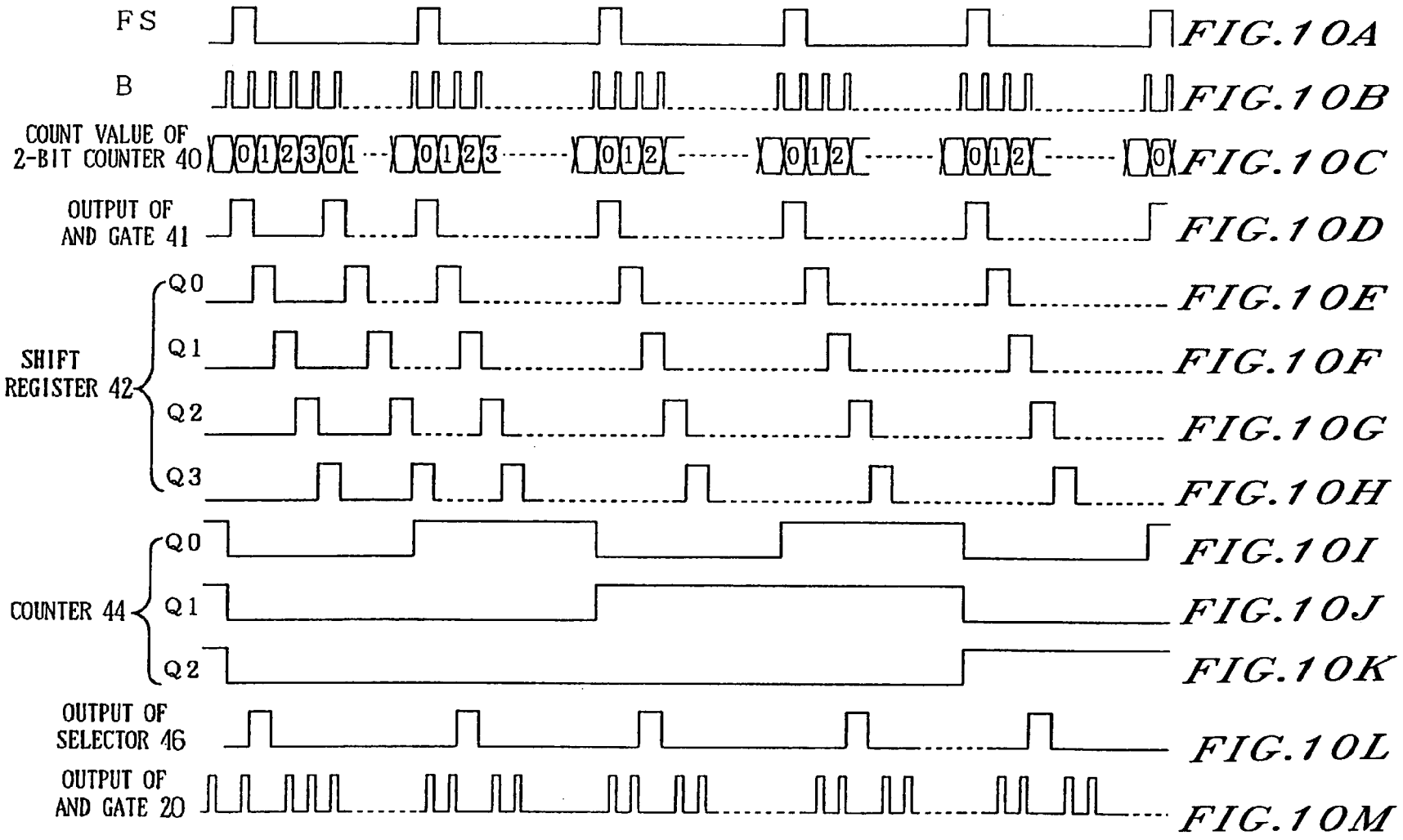
FIG. 10 is a timing chart showing operation of the display controller shown in FIG. 9.
Figure 12A:
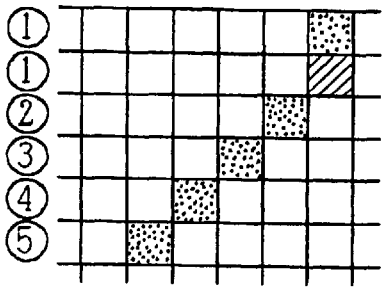
FIG. 12 illustrates states of image display in a case of vertically enlarging/displaying an oblique thin line by the display controller shown in FIG. 9.
Figure 12B:
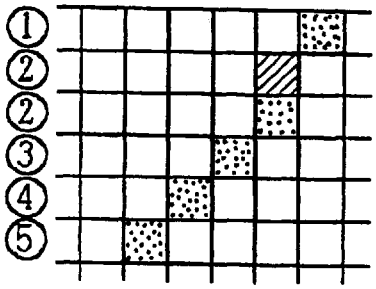
Figure 12C:
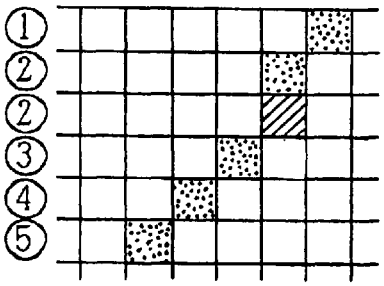
Figure 12D:
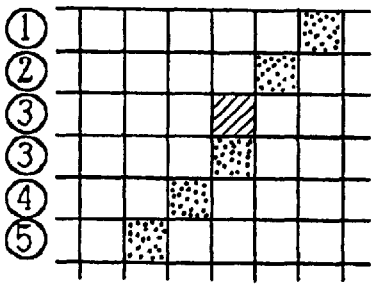
Figure 12E:
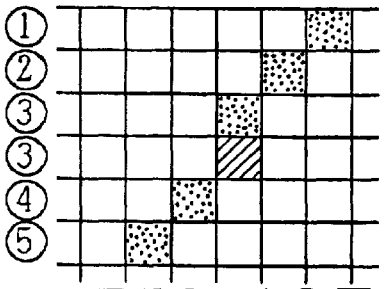
Figure 12F:
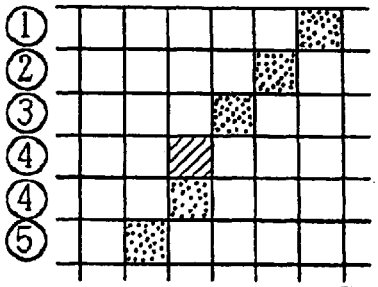
Figure 12G:
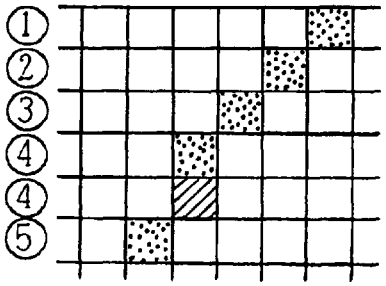
Figure 12H:
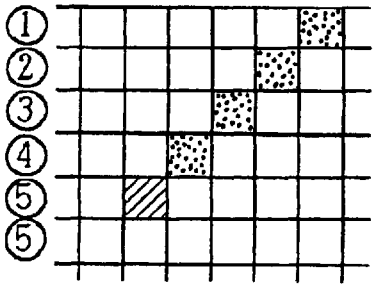
Figures 14A, 14B, 14C, 14D:
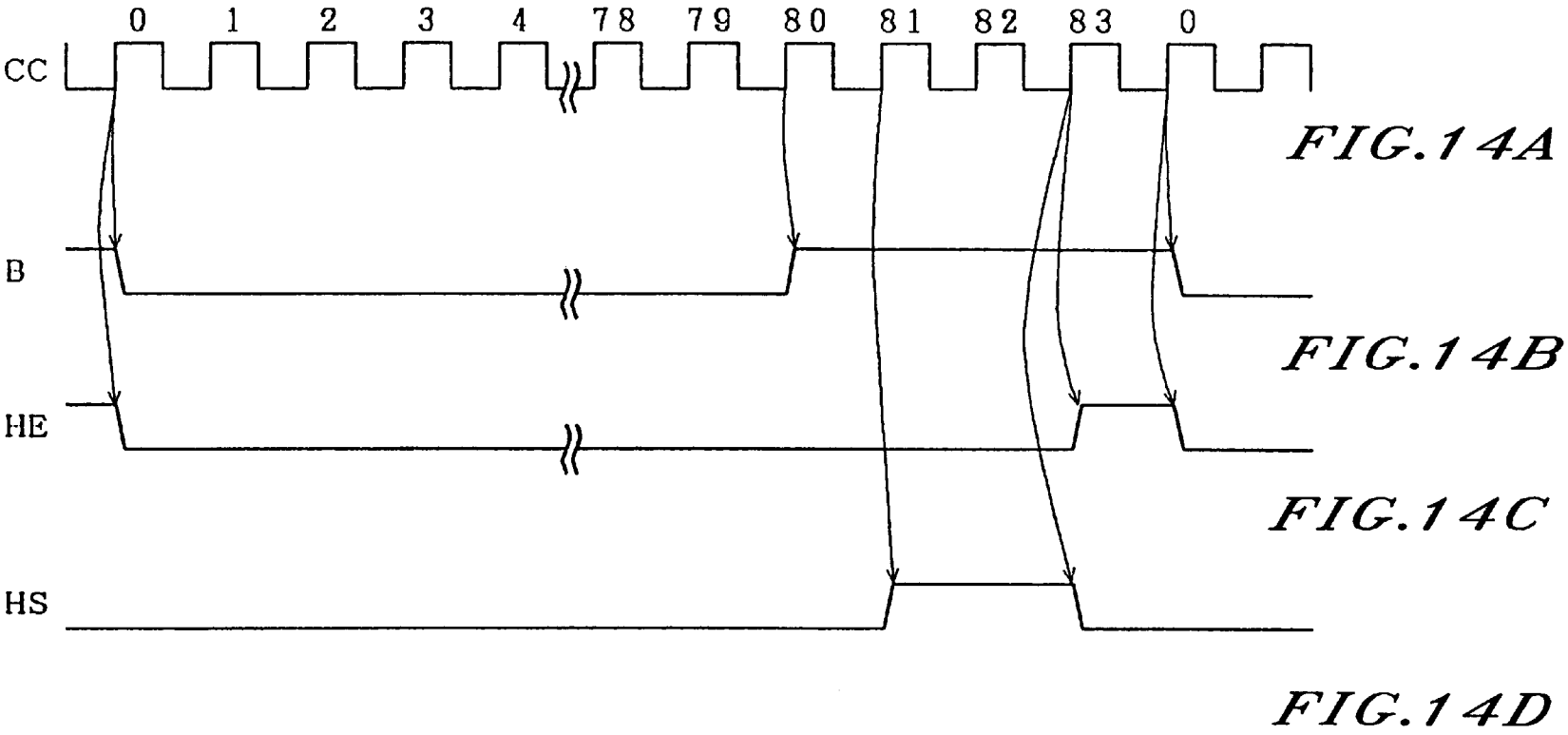
FIG. 14 is a timing chart showing operation of the display controller shown in FIG. 13.
Figure 15:
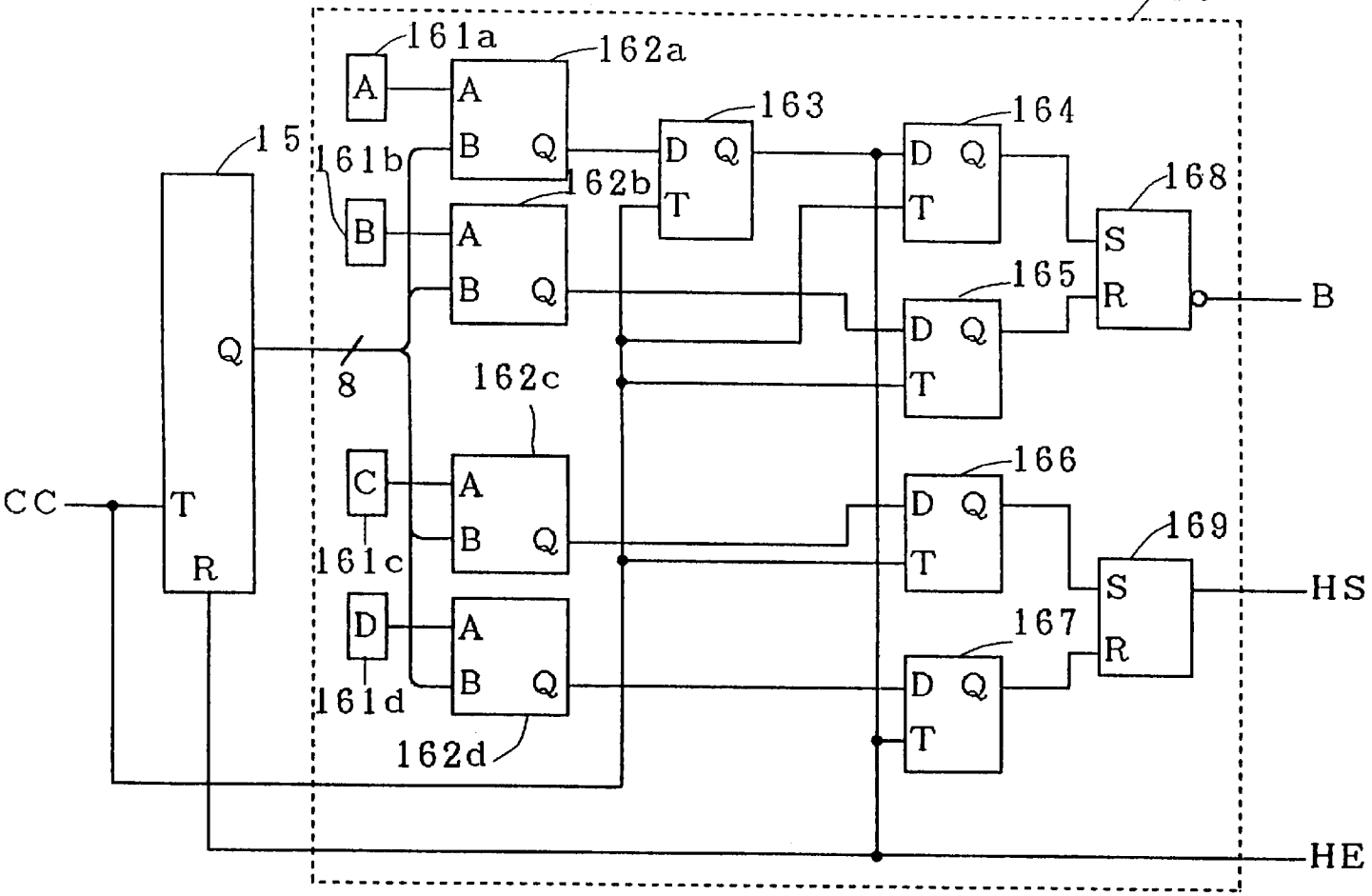
FIG. 15 PRIOR ART
FIG. 15 is a block diagram showing a horizontal timing generation circuit provided in the display controller shown in FIG. 13 in detail.
Figures 16A, 16B, 16C, 16D, 16E, 16F, 16G:
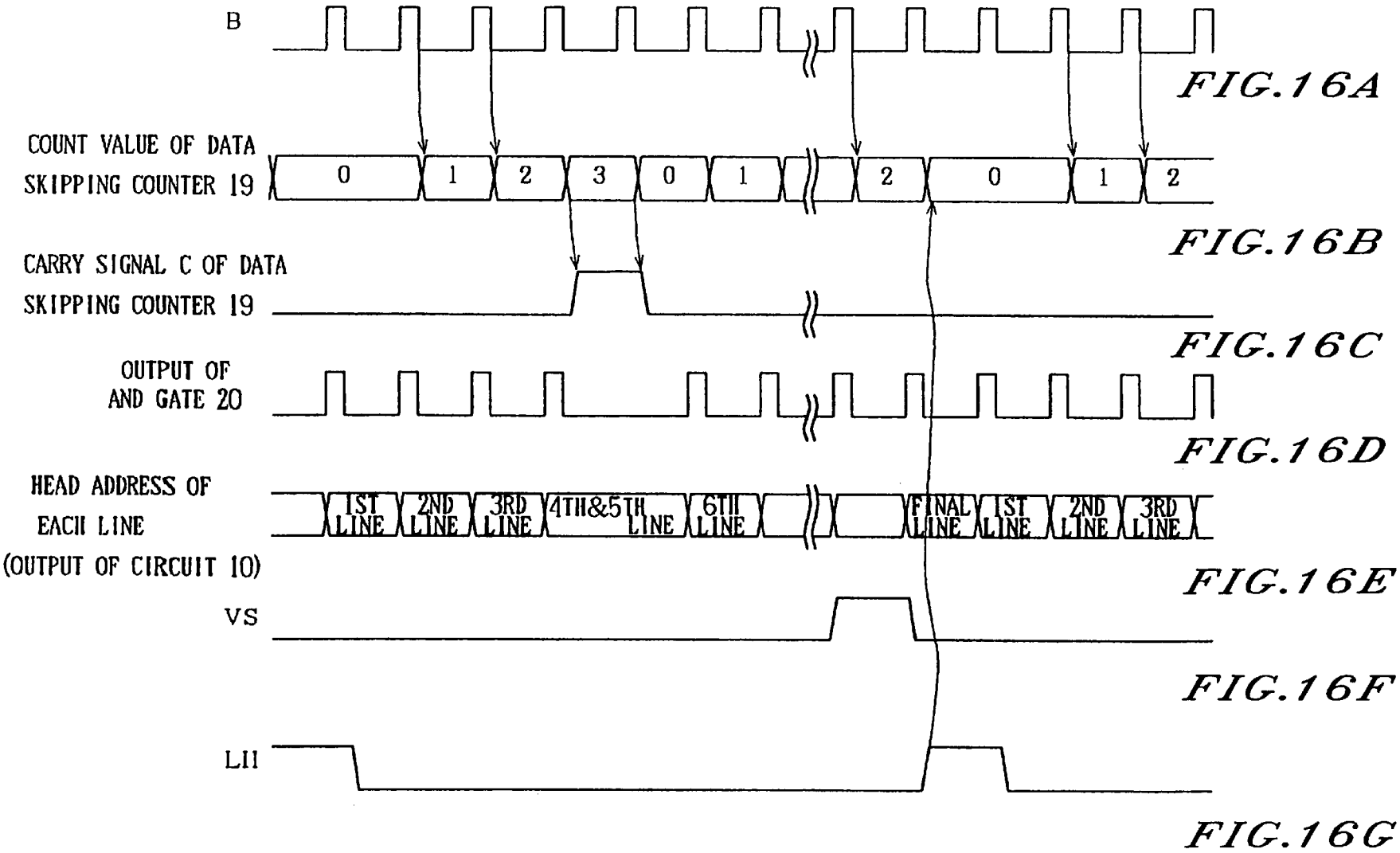
FIG. 16 is a timing chart showing operation of the display controller shown in FIG. 13.

The counter 44 counts the signal FS, to generate outputs Q0 to Q2 shown in a timing chart of FIG. 10. On the other hand, the 2-bit counter 40 counts the signal B, so that the AND gate 41 outputs a high-level signal when its count value is zero, i.e., both of Q0 and Q1 outputs are zero. The output signal of the AND gate 41 is successively shifted by the shift register 42 in accordance with the signal B, as shown in the timing chart of FIG. 10.

The selector 43 successively selects the outputs Q0 to Q3 of the shift register 42 every two frames in accordance with the outputs Q1 and Q2 of the counter 44. In initial two frames, the output Q0 is selected and this signal is supplied to the A input of the selector 46, while the same is supplied to the B input of the selector 46 by a delay by one cycle of the signal B, i.e., by one horizontal cycle, by the D flip-flop 45. In response to the output Q0 from the counter 44, the selector 46 selects the A input in the first frame of the two frames, while selecting the B input in the next frame. In the next two frames, the output Q1 of the shift register 42 is selected by the selector 43, so that an operation similar to the above is repeated. Thus, the selector 46 outputs the signal shown in the timing chart of FIG. 10.

In response to the output of the selector 46, the AND gate 20 data-skips the signal B as shown in the timing chart of FIG. 10. As clearly understood from FIG. 10, the data skipping timing is displaced between odd and even frames by one horizontal scanning line, and successively changed to slower timing along frame progress. Therefore, horizontal scanning lines doubly displaying the same image in correspondence to the data skipping are changed as shown in FIG. 11.

The output of the D flip-flop 45 is supplied to the enable input EN of the adder 34, so that horizontal scanning lines subjected to +1 conversion by the adder 34, i.e., those displaying colors having low chromaticity levels are changed along rectangular frames shown in FIG. 11.

FIG. 12 shows images displayed on the display unit 3 in respective frames when an oblique thin line image is vertically enlarged by the display controller 1 according to the second embodiment shown in FIG. 9. Slant lines show portions displaying a color having low chromaticity. According to this embodiment, the image of each frame is enlarged to 4/3 times, similarly to the aforementioned embodiment. In portions of two horizontal scanning lines doubly displaying the same image, colors of precedent and following horizontal scanning lines are mixed with each other, similarly to the first embodiment. As to the overall screen, the initial image appears to be enlarged in a slightly blurred manner at a frame frequency of about 60 Hz. Thus, it is possible to obtain smooth image display in vertical enlargement with less indentation as compared with the first embodiment.

The first and second modifications shown in FIGS. 7 and 8 described above in relation to the first embodiment are also applicable to the second embodiment.

<Other Modifications>

While the adder 34 is adapted to add 1 to display data serially converted by the shift register 13 in each of the first and second embodiments, the same may alternatively add a numeric value other than 1 for carrying out code conversion.

The adder 34 may be replaced by a circuit for performing various arithmetic operations such as AND, OR and EXOR operations. Further, arrangement of the serial 4-bit data outputted from the shift register 13 may be exchanged.

In the first embodiment, inserted lines (horizontal scanning lines continuously displaying the same image data) may be equalized once every n lines, in response to the magnification in the vertical direction of the screen. This can be easily attained by changing the bit number of the data skipping counter 19 in response to the magnification. Alternatively, the inserted lines may be set to be course in a central part of the screen which has a high possibility of displaying particularly important data while being set to be rough in upper and lower end portions of the screen having low possibilities of displaying important data.

While the inserted lines are downwardly displaced line by line successively every frame progress in the second embodiment, the positions of the inserted lines may alternatively be changed successively in response to frame progress by another prescribed rule. The prescribed rule may have periodicity, or the same may be completely at random with no periodicity.

While the invention has been shown and described in detail, the foregoing description is in all aspects illustrative and not restrictive. It is therefore understood that numerous modifications and variations can be devised without departing from the scope of the invention.

What is claimed is:

1. A display controller for executing control for making a display unit display information in response to data being stored in a display memory, said display controller comprising:

address generation means for generating an address for addressing said display memory; and data transfer means for transferring data being read from said display memory in accordance with said address from said address generation means to said display unit, said address generation means comprising:

means for generating a reference signal having one cycle corresponding to one horizontal scanning period of said display unit, data skipping means for inactivating said reference signal once every n horizontal scanning lines thereby data-skipping said reference signal, data skipping timing change means for displacing data skipping timing by said data skipping means between odd and even frames by one horizontal scanning line, and address formation means for forming said address every horizontal scanning line by changing a head address in response to said reference signal being data-skipped by said data skipping means at timing being changed by said data skipping timing change means.

2. A display controller in accordance with claim 1, wherein said data transfer means comprises data change means for making prescribed change on said data being read from said display memory in response to data skipping timing of said data skipping means.

3. A display controller in accordance with claim 1, wherein said data transfer means comprises:

first and second color conversion tables for reading color image data in accordance with a prescribed rule through an address of said data being read from said display memory, and selection means for selecting either one of said first and second color conversion tables in response to data skipping timing of said data skipping means.

4. A display controller for executing control for making a display unit display information in response to data being stored in a display memory, said display controller comprising:

address generation means for generating an address for addressing said display memory; and data transfer means for transferring data being read from said display memory in accordance with said address from said address generation means to said display unit, said address generation means comprising:

means for generating a reference signal having one cycle corresponding to one horizontal scanning period of said display unit, data skipping means for inactivating said reference signal once every n horizontal scanning lines thereby data-skipping said reference signal, data skipping timing change means for displacing data skipping timing by said data skipping means between odd and even frames by one horizontal scanning line while changing the same in accordance with a prescribed rule in response to frame progress, and address formation means for forming said address every horizontal scanning line by changing head address in response to said reference signal being data-skipped by said data skipping means at timing being changed by said data skipping time change means.

5. A display controller in accordance with claim 4, wherein said data transfer means comprises data change means for making prescribed change on said data being read from said display memory in response to data skipping timing of said data skipping means.

6. A display controller in accordance with claim 4, wherein said data transfer means comprises:

first and second color conversion tables for reading color image data in accordance with a prescribed rule through an address of said data being read from said display memory, and selection means for selecting either one of said first and second color conversion tables in response to data skipping timing of said data skipping means.

* * * * *